US009604482B2

(12) United States Patent
Maeshima et al.

(10) Patent No.: US 9,604,482 B2
(45) Date of Patent: Mar. 28, 2017

(54) ADJUSTMENT MECHANISM, IMAGE FORMING APPARATUS INCLUDING ADJUSTMENT MECHANISM, AND ADJUSTMENT METHOD USING ADJUSTMENT MECHANISM

(71) Applicant: KYOCERA Document Solutions Inc., Osaka (JP)

(72) Inventors: Masanobu Maeshima, Osaka (JP); Kikunosuke Tsuji, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/023,822

(22) PCT Filed: Jun. 10, 2015

(86) PCT No.: PCT/JP2015/066726

§ 371 (c)(1),
(2) Date: Mar. 22, 2016

(87) PCT Pub. No.: WO2015/198864

PCT Pub. Date: Dec. 30, 2015

(65) Prior Publication Data

US 2016/0236490 A1 Aug. 18, 2016

(30) Foreign Application Priority Data

Jun. 24, 2014 (JP) ..... 2014-129428

(51) Int. Cl.
*B41J 25/00* (2006.01)
*B41J 2/21* (2006.01)

(52) U.S. Cl.
CPC ..... *B41J 25/001* (2013.01); *B41J 2/2146* (2013.01)

(58) Field of Classification Search
CPC ..... B41J 2/512; B41J 25/003; B41J 25/001; B41J 25/005; B41J 2/01
See application file for complete search history.

(56) References Cited

U.S. PATENT DOCUMENTS 8,360,553 B2 1/2013 Sakakibara
2011/0310175 A1* 12/2011 Sakakibara ..... B41J 25/3082 347/37
2012/0044296 A1* 2/2012 Gouch ..... B41J 2/155 347/40

FOREIGN PATENT DOCUMENTS

JP 2002-019097 A 1/2002
JP 2012-000891 A 1/2012

OTHER PUBLICATIONS

International Search Report—PCT/JP2015/066726 mailed Jul. 7, 2015.

* cited by examiner

*Primary Examiner* — Henok Legesse
(74) *Attorney, Agent, or Firm* — Studebaker & Brackett PC

(57) ABSTRACT

An adjustment mechanism (130) adjusts a position of a target object (110) attached to an attachment base (120). The adjustment mechanism (130) includes a first cam (131) and a second cam (132). The first cam (131) is attached to a shaft portion (123) on the attachment base (120). The second cam (132) houses the first cam (131) and supports the target object (110). The first cam (131) displaces the target object (110) via the second cam (132) by rotating about the shaft section (123) as a rotational axis. The second cam (132) displaces the target object (110) by rotating about the first cam (131) as a rotational axis. An amount of displacement of the target object (110) resulting from rotation of the first cam (131) differs from an amount of displacement of the target object (110) resulting from rotation of the second cam (132).

17 Claims, 20 Drawing Sheets

ADJUSTMENT MECHANISM, IMAGE FORMING APPARATUS INCLUDING ADJUSTMENT MECHANISM, AND ADJUSTMENT METHOD USING ADJUSTMENT MECHANISM

TECHNICAL FIELD

The present invention relates to an adjustment mechanism for adjusting a position of a target object attached to an attachment base, an image forming apparatus including the adjustment mechanism, and an adjustment method using the adjustment mechanism.

BACKGROUND ART

One example of a type of image forming apparatus that forms images on recording media is an image forming apparatus that adopts an inkjet method (referred to below as an "inkjet recording apparatus"). The inkjet recording apparatus for example includes a plurality of recording heads and a conveyance device. The recording heads each include a plurality of rows of nozzles that eject ink droplets. The conveyance device conveys a sheet of paper, which is a recording medium. The inkjet recording apparatus forms an image on the sheet through each of the recording heads ejecting ink droplets to form dots on the sheet when the sheet is conveyed thereto by the conveyance device.

Typically the recording heads are each positioned at a specific position inside of the inkjet recording apparatus such that the nozzle rows therein are opposite to the conveyance device and such that the nozzle rows are oriented perpendicularly to a sheet conveyance direction. In a situation in which the nozzle rows have a slanted orientation relative to a direction perpendicular to the sheet conveyance direction, the slanting of the nozzle rows causes a shift in positions at which dots are formed (dot formation positions). Consequently, a poorer quality image is formed on the sheet. Therefore, when the recording heads are attached to the inkjet recording apparatus, it is important that positions of the recording heads are precisely adjusted so that the nozzle rows are oriented perpendicularly to the sheet conveyance direction.

PTL1 discloses an example of a printing apparatus in which a shift in dot formation positions is adjusted and printed image quality is improved. The printing apparatus includes a plurality of nozzle units, a sub-carriage, a carriage, and a slant adjusting section. The nozzle units form dots. The sub-carriage can integrally fix the nozzle units. The sub-carriage is attached to the carriage and can slide in a main scanning direction. The slant adjusting section adjusts slanting of the sub-carriage in a yawing direction relative to the main scanning direction. A cam mechanism is used in the slant adjusting section of the printing apparatus.

CITATION LIST

Patent Literature

[PTL 1]
Japanese Patent Application Laid-Open Publication No. 2002-19097

SUMMARY OF INVENTION

Technical Problem

Inkjet recording apparatuses that achieve increased resolution and improved image formation speed have recently been launched onto the market. Such inkjet recording apparatuses tend to include recording heads having an increased number of nozzles rows.

However, one problem associated with an increase in the number of nozzle rows in a recording head is that slanting of the nozzle rows tends to cause a larger shift in dot formation positions. The reason for the above is that in a recording head that includes a large number of nozzle rows, nozzle orifices are present further from a nozzle orifice used as a reference (reference orifice) in dot formation. The dot formation position of a nozzle orifice located further from the reference orifice is more greatly affected by slanting of the nozzle rows and thus is shifted further. Therefore, an inkjet recording apparatus that includes a large number of nozzle rows requires more precise adjustment of recording head positioning.

For example, in a situation in which the cam mechanism disclosed in PTL 1 is used to adjust the position of such a recording head, a cam mechanism having a small amount of displacement is adopted. Consequently, a person who attaches and adjusts the recording head (referred to below as an adjustor) can precisely adjust the position of the recording head. However, it is difficult for the adjustor to initially attach the recording head at a position close to an optimal position (specifically, at a position from which the recording head can be displaced to the optimal position using the cam mechanism having the small amount of displacement). Therefore, even if the cam mechanism having the small amount of displacement is provided, it is difficult for the adjustor to precisely adjust the position of the recording head to the optimal position using the cam mechanism.

Adjustment of the position of a recording head is performed, for example, not only during manufacture of an inkjet recording apparatus, but is also performed during recording head replacement after the inkjet recording apparatus has been released onto the market. Therefore, an adjustment mechanism is required that enables simple and precise adjustment not just by a manufacturer, but also by a servicing technician who replaces recording heads.

The present invention was conceived in consideration of the problems described above and an objective thereof is to provide an adjustment mechanism that enables simple and precise adjustment of a position of a target object (for example, a recording head) attached to an attachment base, an image forming apparatus including the adjustment mechanism, and an adjustment method using the adjustment mechanism.

Solution to Problem

An adjustment mechanism according to one aspect of the present invention is for adjusting a position of a target object attached to an attachment base. The adjustment mechanism includes a first cam and a second cam. The first cam is attachable to a shaft section provided on the attachment base. The second cam internally houses the first cam and supports the target object. The first cam displaces the target object via the second cam by rotating about the shaft section as a rotational axis. The second cam displaces the target object by rotating about the first cam as a rotational axis. An amount of displacement of the target object resulting from rotation of the first cam differs from an amount of displacement of the target object resulting from rotation of the second cam.

An image forming apparatus according to another aspect of the present invention is for forming an image on a recording medium. The image forming apparatus includes an adjustment mechanism, an attachment base, and a recording head that is a target object. The adjustment mechanism adjusts a position of the target object attached to the attachment base. The adjustment mechanism includes a first cam and a second cam. The first cam is attached to a shaft section provided on the attachment base. The second cam internally houses the first cam and supports the target object. The first cam displaces the target object via the second cam by rotating about the shaft section as a rotational axis. The second cam displaces the target object by rotating about the first cam as a rotational axis. An amount of displacement of the target object resulting from rotation of the first cam differs from an amount of displacement of the target object resulting from rotation of the second cam.

An adjustment method according to another aspect of the present invention uses an adjustment mechanism to adjust a position of a target object attached to an attachment base. The adjustment mechanism includes a first cam and a second cam. The first cam is attached to a shaft section provided on the attachment base. The second cam internally houses the first cam and supports the target object. The first cam displaces the target object via the second cam by rotating about the shaft section as a rotational axis. The second cam displaces the target object by rotating about the first cam as a rotational axis. An amount of displacement of the target object resulting from rotation of the first cam differs from an amount of displacement of the target object resulting from rotation of the second cam. The amount of displacement of the target object resulting from rotation of the first cam is smaller than the amount of displacement of the target object resulting from rotation of the second cam. The adjustment method includes (i) to (iii) shown below. (i) Roughly adjusting the position of the target object relative to the attachment base by rotating the second cam. (ii) Finely adjusting the position of the target object relative to the attachment base by rotating the first cam. (iii) Fixing the target object to the attachment base using a fastening member after the position of the target object has been adjusted through either or both of the roughly adjusting and the finely adjusting.

Advantageous Effects of Invention

According to the present invention, an adjustment mechanism that enables simple and precise adjustment of a position of a target object (for example, a recording head) attached to an attachment base, an image forming apparatus including the adjustment mechanism, and an adjustment method using the adjustment mechanism are provided.

DESCRIPTION OF EMBODIMENTS

The following explains an embodiment of the present invention with reference to the drawings. However, the embodiment explained below does not limit the invention according to the claims. Elements described in the embodiment are not necessarily all essential in order to solve the problems addressed by the present invention. When the same reference sign is used in more than one of the drawings, the reference sign indicates the same element in each drawing.

Figure 1:
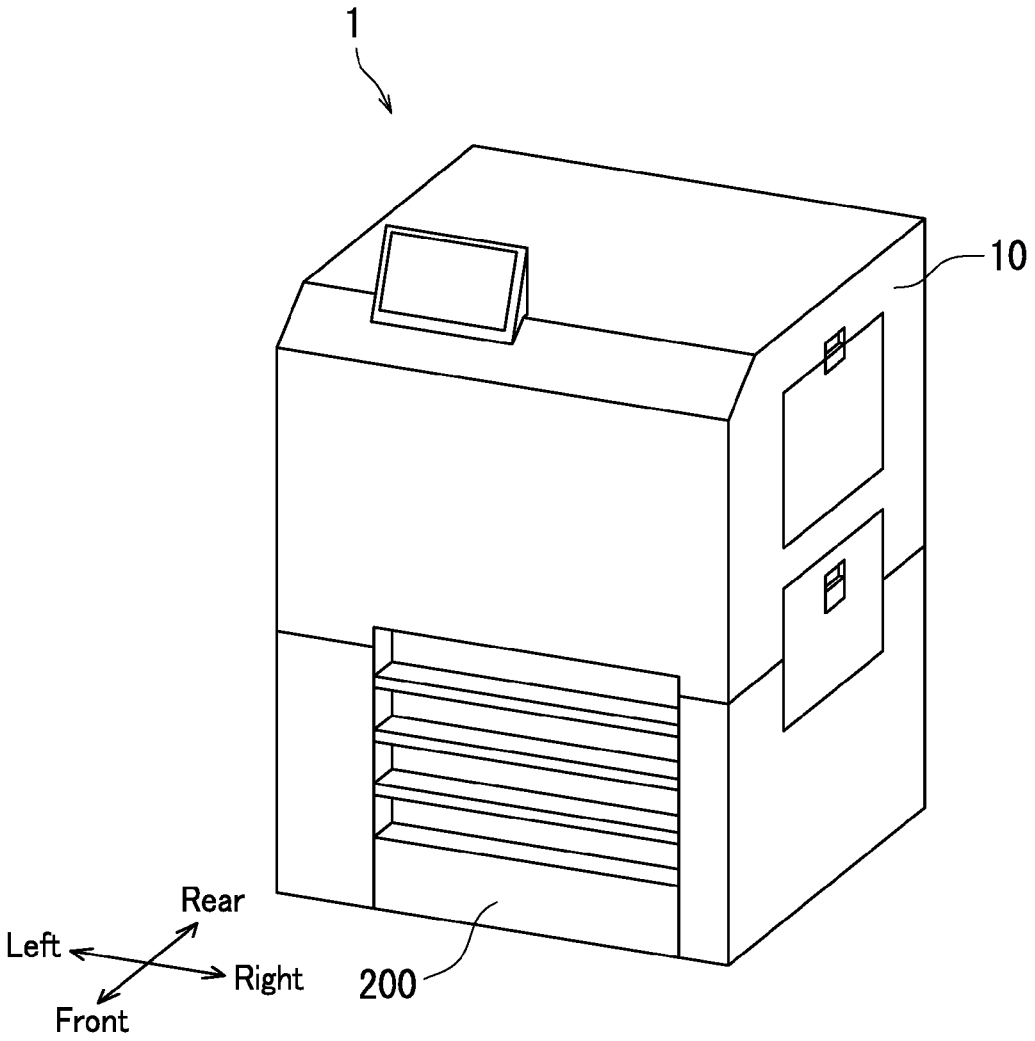
FIG. 1 is a perspective view illustrating an image forming apparatus according to an embodiment of the present invention.
Figure 2:
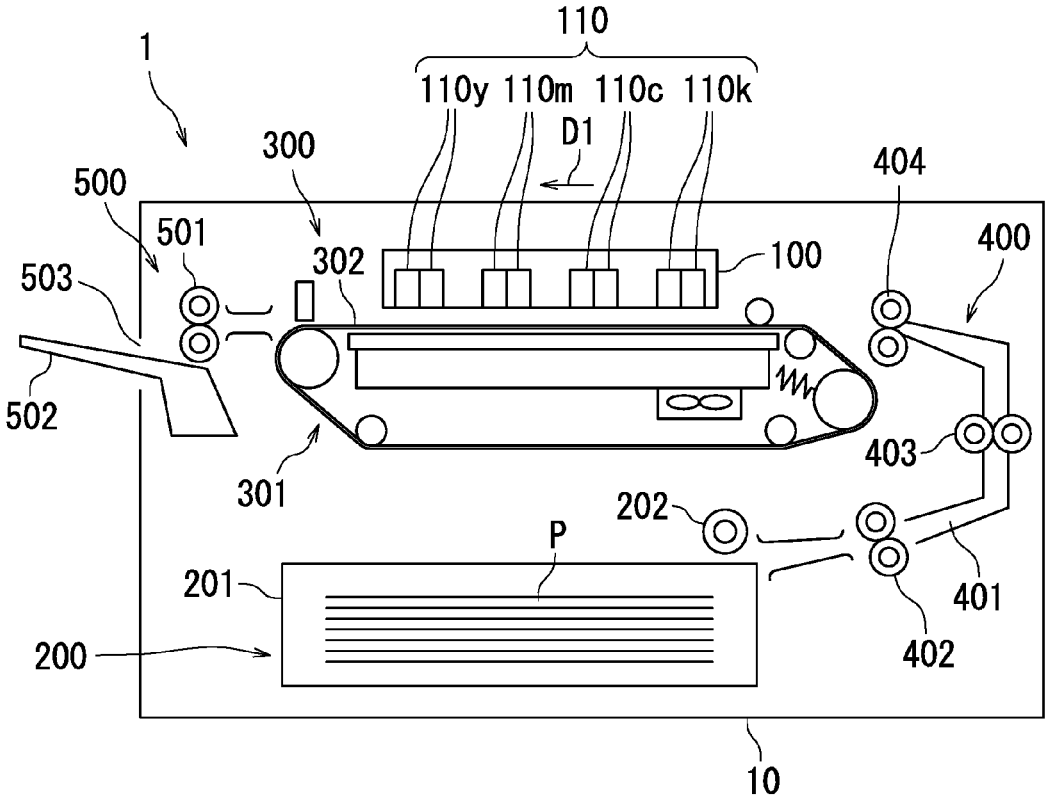
FIG. 2 illustrates configuration of the image forming apparatus according to the embodiment of the present invention.

FIG. 1 is a perspective view illustrating an image forming apparatus 1 according to the present embodiment. FIG. 2 illustrates configuration of the image forming apparatus 1 according to the present embodiment. The right side of FIG. 2 corresponds to the right side of the image forming apparatus 1 as viewed from in front and the left side of FIG. 2 corresponds to the left side of the image forming apparatus 1 as viewed from in front.

The image forming apparatus 1 according to the present embodiment is an inkjet recording apparatus. As illustrated in FIG. 2, the image forming apparatus 1 includes an apparatus housing 10, a sheet feed section 200, an image forming section 300, a sheet conveyance section 400, and a sheet ejection section 500. In the present embodiment, the sheet feed section 200 is located in a lower part of the apparatus housing 10. The image forming section 300 is located above the sheet feed section 200. The sheet conveyance section 400 is located to one side of the image forming section 300. The sheet ejection section 500 is located to the other side of the image forming section 300.

The sheet feed section 200 includes a sheet feed cassette 201 and a sheet feed roller 202. The sheet feed cassette 201 is freely attachable to and detachable from the apparatus housing 10. The sheet feed cassette 201 is loaded with a plurality of sheets P in a stacked state. The sheet feed roller 202 picks up sheets P one by one from the sheet feed cassette 201 and feeds the sheets P to the sheet conveyance section 400.

The sheet conveyance section 400 includes a sheet conveyance path 401, a first pair of conveyance rollers 402, a second pair of conveyance rollers 403, and a pair of registration rollers 404. The first pair of conveyance rollers 402 feeds a sheet P into the sheet conveyance path 401 once the sheet P is fed from the sheet feed section 200. The second pair of conveyance rollers 403 conveys the sheet P downstream in the sheet conveyance path 401 once the sheet P is conveyed from the first pair of conveyance rollers 402. The pair of registration rollers 404 performs skew correction of the sheet P conveyed from the second pair of conveyance rollers 403. The pair of registration rollers 404 temporarily halts the sheet P in order to synchronize timing of image formation on the sheet P and conveyance of the sheet P. The pair of registration rollers 404 feeds the sheet P to the image forming section 300 in accordance with image formation timing.

The image forming section 300 forms an image on the sheet P. The image forming section 300 includes a head unit 100 and a conveyance device 301. The head unit 100 and the conveyance device 301 are located opposite to one another. The conveyance device 301 places the sheet P onto a conveyor belt 302 once the sheet P is conveyed from the sheet conveyance section 400 and conveys the sheet P in a conveyance direction D1. Herein, the conveyance direction D1 is a direction toward the sheet ejection section 500 from the sheet conveyance section 400 and, in the present embodiment, is a direction toward the left side of the image forming apparatus 1 from the right side thereof.

The head unit 100 includes a plurality of different types (four types in the present embodiment) of recording heads (referred to below simply as "heads") 110. The four types of heads 110 are, more specifically, black heads 110*k* that eject black colored ink droplets, cyan heads 110*c* that eject cyan colored ink droplets, magenta heads 110*m* that eject magenta colored ink droplets, and yellow heads 110*y* that eject yellow colored ink droplets. The head unit 100 includes a plurality (three in the present embodiment) of each of the types of heads 110. Thus, the head unit 100 in the present embodiment includes a total of 12 (4 (number of head types)×3 (number of heads of each type)) heads 110. The four types of heads 110*k*, 110*c*, 110*m*, and 110*y* have an order from upstream to downstream in the conveyance direction D1 of: black heads 110*k*, cyan heads 110*c*, magenta heads 110*m*, yellow heads 110*y*. The head unit 100 is explained in detail further below with reference to FIGS. 3 and 4.

The conveyance device 301 conveys the sheet P to positions opposite nozzle units 111 (refer to FIG. 4) of the four types of heads 110*k*, 110*c*, 110*m*, and 110*y* in order. The four types of heads 110*k*, 110*c*, 110*m*, and 110*y* each eject ink droplets onto the sheet P when the sheet P is conveyed to a position opposite to the nozzle units 111 thereof. As a result, an image is formed on the sheet P. The conveyance device 301 conveys the sheet P to the sheet ejection section 500 once the image has been formed thereon.

The sheet ejection section 500 includes a pair of ejection rollers 501, an exit tray 502, and an exit port 503. The exit tray 502 is fixed to the apparatus housing 10 such as to protrude outside of the apparatus housing 10 from the exit port 503. The sheet P conveyed from the image forming section 300 is ejected onto the exit tray 502 by the pair of ejection rollers 501, via the exit port 503.

Figure 3:
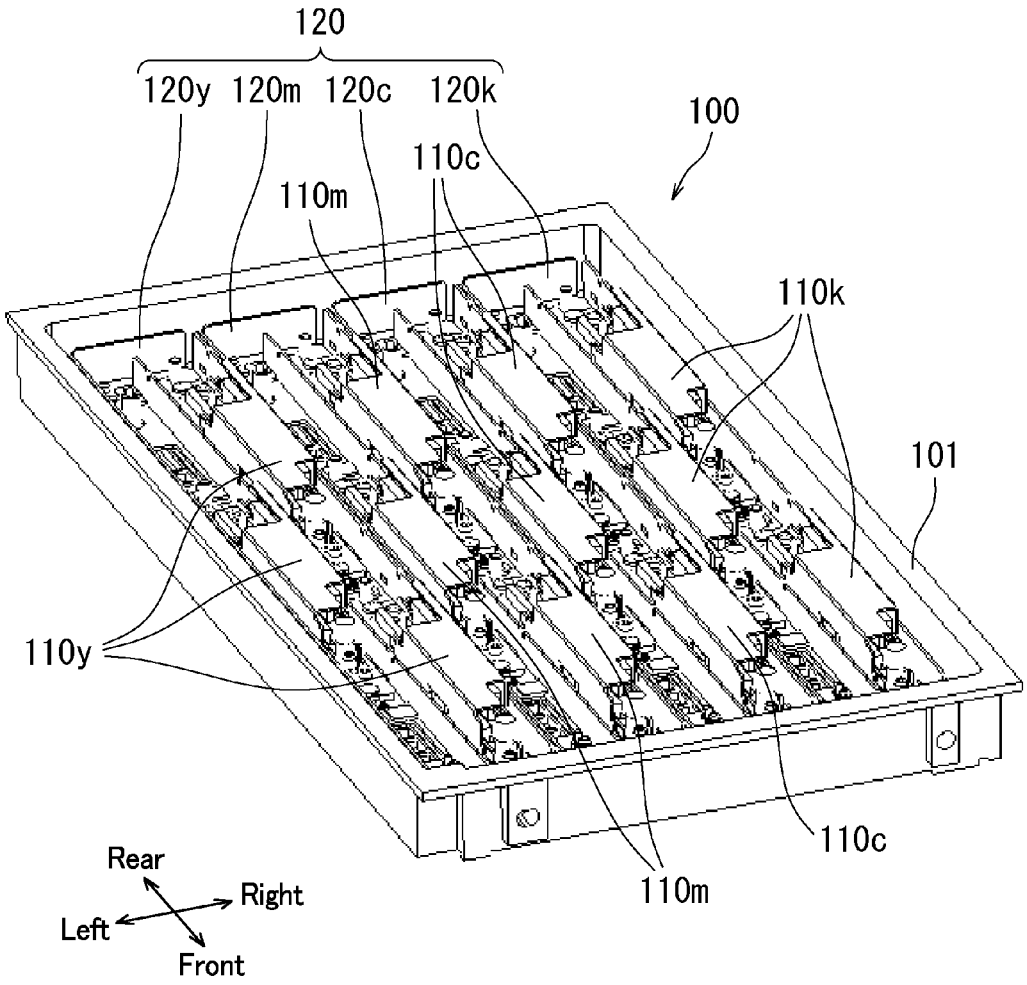
FIG. 3 is a first perspective view illustrating a head unit according to the embodiment of the present invention.
Figure 4:
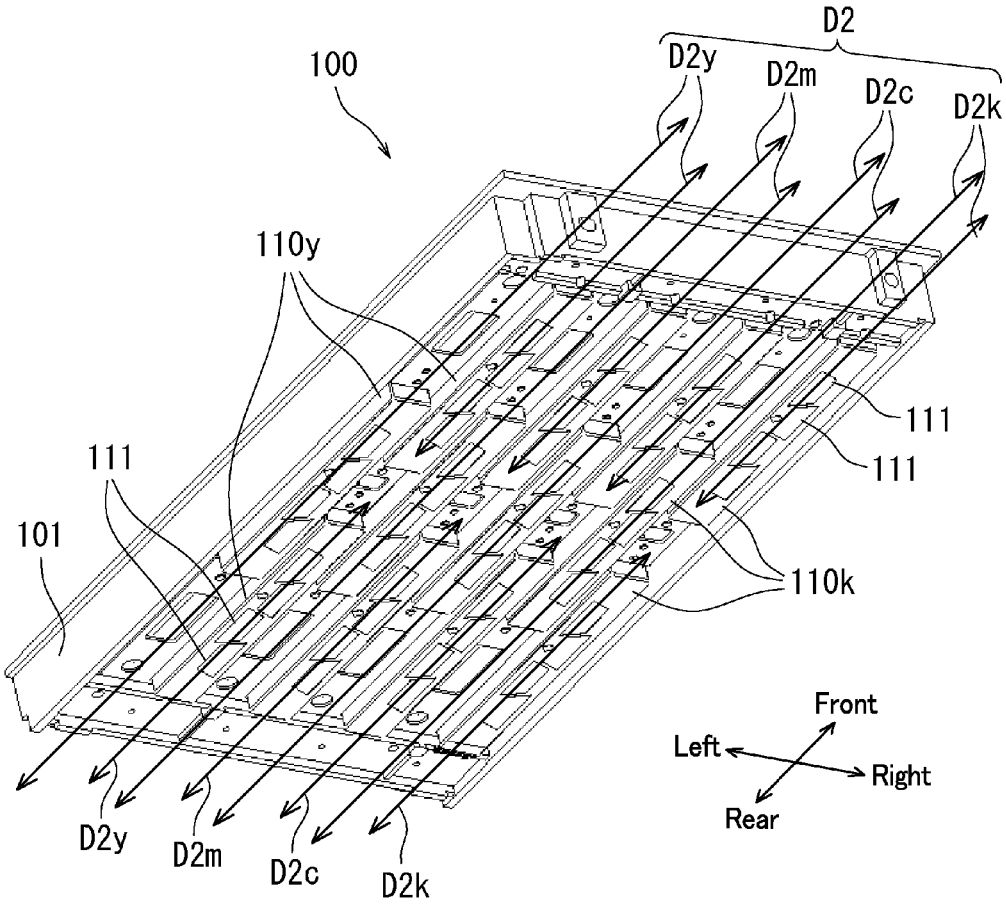
FIG. 4 is a second perspective view illustrating the head unit according to the embodiment of the present invention.

FIG. 3 is a first perspective view illustrating the head unit 100 according to the present embodiment. FIG. 4 is a second perspective view illustrating the head unit 100 according to the present embodiment.

The first perspective view in FIG. 3 is a view seeing the head unit 100 from above and illustrates configuration of an opposite side of the head unit 100 to a side of the head unit 100 that faces the conveyance device 301. The second perspective view in FIG. 4 is a view seeing the head unit 100 seeing from below and illustrates configuration of the side of the head unit 100 that faces the conveyance device 301. The side that faces the conveyance device 301 is referred to below as a "facing side." The opposite side to the side facing the conveyance device 301 is referred to as a "non-facing side." Configuration of the head unit 100 is explained below with reference to FIGS. 3 and 4.

As illustrated in FIG. 3, a housing (referred to below as a "unit housing") 101 of the head unit 100 is a box-like shape having an open top. In the unit housing 101, head bases (referred to below simply as "bases") 120 that are attachment bases are arranged in a left-right direction of the head unit 100; the number of bases 120 (four in the present embodiment) corresponds to the number of types of heads 110. The four bases 120 are, more specifically, a black base 120*k* to which the black heads 110*k* are attached, a cyan base 120*c* to which the cyan heads 110*c* are attached, a magenta base 120*m* to which the magenta heads 110*m* are attached, and a yellow base 120*y* to which the yellow heads 110*y* are attached.

The plurality (three in the present embodiment) of heads 110 of each type are arranged on the corresponding base 120 in a staggered formation along a front-back direction of the head unit 100. In other words, the three black heads 110*k* are arranged on the black base 120*k* in a staggered formation along the front-back direction of the head unit 100. In the same way, the three cyan heads 110*c* are arranged on the cyan base 120*c* in a staggered formation along the front-back direction of the head unit 100. In the same way, the three magenta heads 110*m* are arranged on the magenta base 120*m* in a staggered formation in the front-back direction of the head unit 100. In the same way, the three yellow heads 110*y* are arranged on the yellow base 120*y* in a staggered formation in the front-back direction of the head unit 100.

As illustrated in FIG. 4, a plurality (four in the present embodiment) of nozzle units 111 that eject ink droplets of a corresponding color are provided at the facing side of each of the heads 110. In other words, the three black heads 110*k* each include four nozzle units 111 that eject black colored ink droplets. In the same way, the three cyan heads 110*c* each include four nozzle units 111 that eject cyan colored ink droplets. In the same way, the three magenta heads 110*m* each include four nozzle units 111 that eject magenta colored ink droplets. In the same way, the three yellow heads 110*y* each include four nozzle units 111 that eject yellow colored ink droplets. Thus, the head unit 100 in the present embodiment includes a total of 48 (4 (number of head types)×3 (number of heads of each type)×4 (number of nozzle units in each head)) nozzle units 111. Note that reference signs for the cyan heads 110*c* and the magenta heads 110*m* are omitted in FIG. 4 for the sake of convenience. Furthermore, reference signs are only shown for some of the head units 111.

Figure 8:
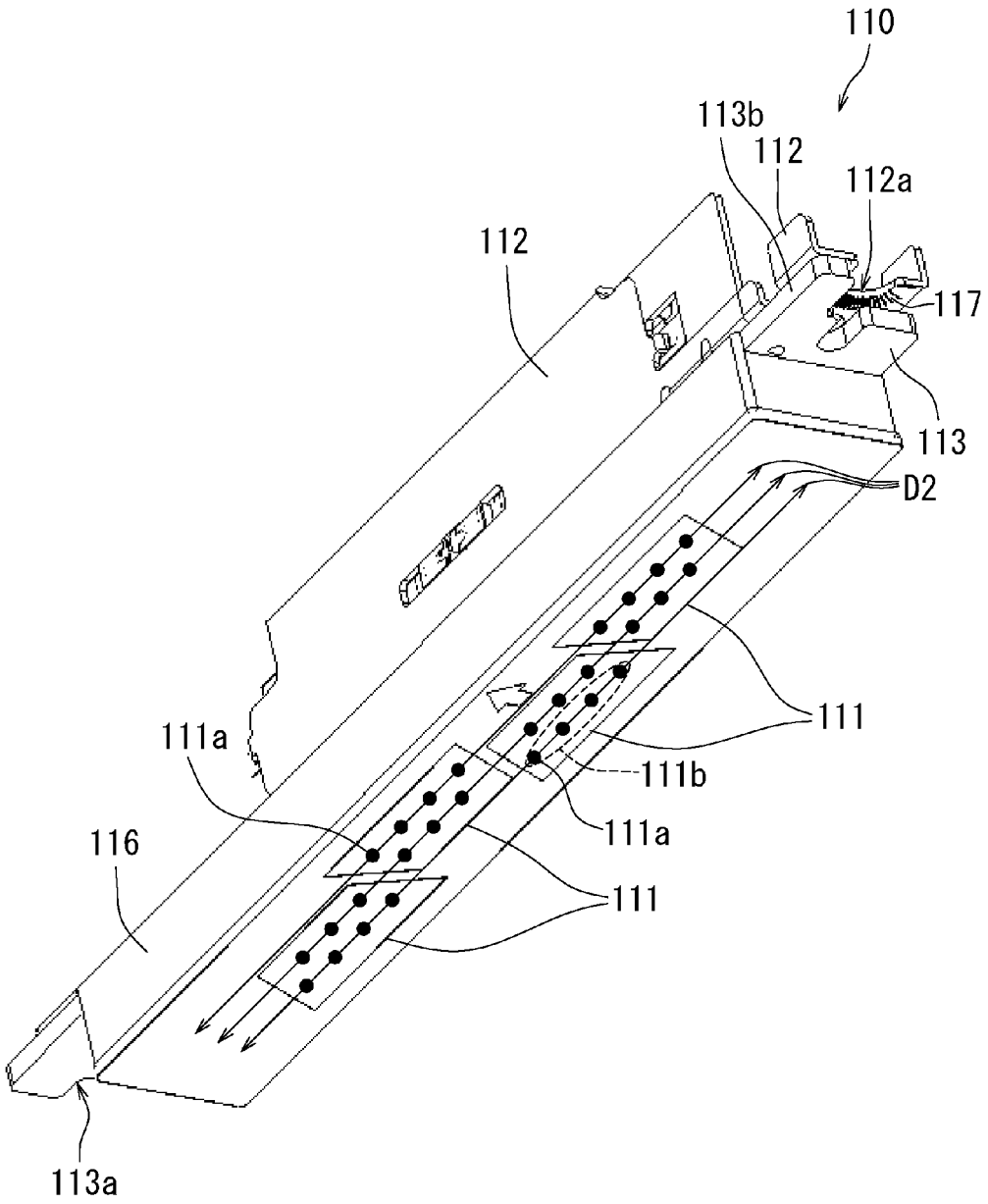
FIG. 8 is a second perspective view illustrating the recording head according to the embodiment of the present invention.

Arrows D2 in FIG. 4 indicate the orientation of nozzle rows. The nozzle rows are formed on the nozzle units 111 of the heads 110. As illustrated in FIG. 8, each of the nozzle rows is a row 111*b* composed of a plurality of nozzle orifices 111*a* that eject ink. In the present embodiment, there are two nozzle rows 111*b* in each of the nozzle units 111. A plurality of nozzle orifices 111*a* composing the two nozzle rows 111*b* are arranged in a staggered formation in a longitudinal direction of the heads 110. Consequently, the orientation D2 of the nozzle rows 111*b* is parallel to the longitudinal direction of the heads 110. The four nozzle units 111 on each of the heads 110 are integrally fixed to the head 110 such that the orientation D2 of the nozzle rows 111*b* in the four nozzle units 111 is parallel to the longitudinal direction of the head 110.

Referring once more to FIG. 4, arrows D2*k* indicate the orientation of nozzle rows 111*b* in the nozzle units 111 of the black heads 110*k*. Arrows D2*c* indicate the orientation of nozzle rows 111*b* in the nozzle units 111 of the cyan heads 110*c*. Arrows D2*m* indicate the orientation of nozzle rows 111*b* in the nozzle units 111 of the magenta heads 110*m*. Arrows D2*y* indicate the orientation of nozzle rows 111*b* in the nozzle units 111 of the yellow heads 110*y*.

In a situation in which the orientation D2 of the nozzle rows 111*b* is slanted from a direction perpendicular to the sheet conveyance direction D1, dot formation positions are shifted in accordance with the slanting and a poorer quality image is formed on the sheet P. Therefore, it is necessary for each of the heads 110 to be located on the corresponding base 120 such that the orientation D2 of the nozzle rows 111*b* in the head 110 is perpendicular to the sheet conveyance direction D1. In other words, the orientations D2*k*, D2*c*, D2*m*, and D2*y* of the nozzle rows 111*b* in the heads 110 are required to be parallel to one another and perpendicular to the conveyance direction D1. Note that in the present embodiment, front, back, left, and right of the head unit 100 correspond to front, back, left, and right of the image forming apparatus 1. Therefore, the left-right direction of the head unit 100 is parallel to the sheet conveyance direction D1 and the front-back direction of the head unit 100 is perpendicular to the sheet conveyance direction D1.

Each of the heads 110 is detachably attached to the corresponding base 120 such as to be replaceable. The heads 110 and the bases 120 have individual differences and tolerances in production. Therefore, even if heads 110 of the same type are attached to a base 120 at the same position, the orientation D2 of the nozzle rows 111*b* is not necessarily the same for both of the heads 110. Therefore, during attachment of a head 110 to a base 120 by a person assembling the image forming apparatus 1 or a person attaching the head 110 as a replacement, the person is required to adjust the position of the head 110 such that the orientation D2 of the nozzle rows 111*b* in the head 110 is parallel to the orientation D2 of other nozzle rows 111*b* and perpendicular to the sheet conveyance direction D1.

Figure 5:
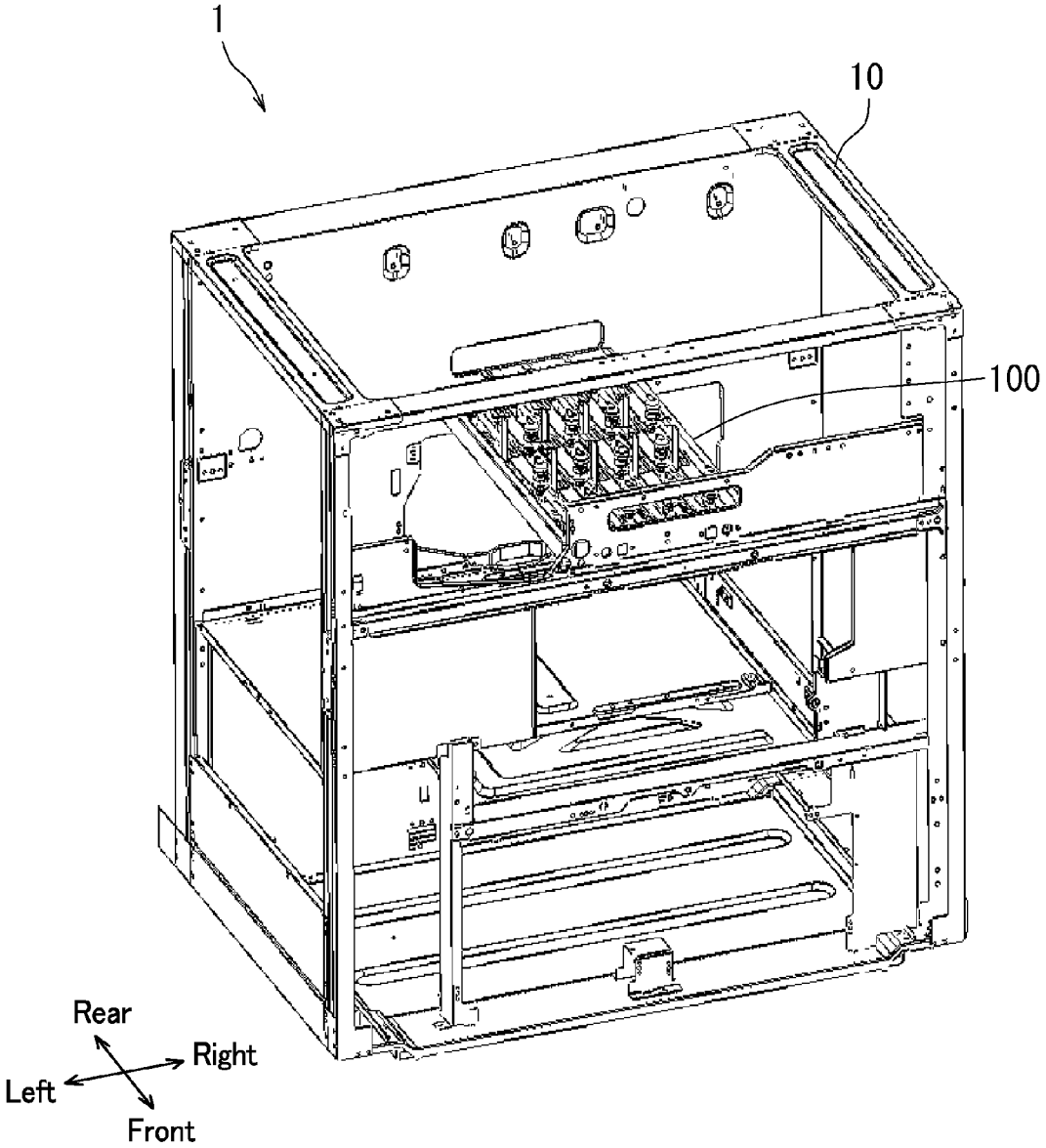
FIG. 5 illustrates a position of the head unit in the image forming apparatus according to the embodiment of the present invention.

FIG. 5 illustrates a position of the head unit 100 in the image forming apparatus according to the present embodiment.

As illustrated in FIG. 5, the head unit 100 is fixed at a specific position in the apparatus housing 10 such that front, back, left and right of the head unit 100 correspond to front, back, left, and right of the image forming apparatus 1. In other words, the right side of the head unit 100 at which the black base 120*k* is housed is located at the right side of the image forming apparatus 1 and the left side of the head unit 100 at which the yellow base 120*y* is housed is located at the left side of the image forming apparatus 1. Through the above, the four types of heads 110*k*, 110*c*, 110*m*, and 110*y* are arranged from upstream to downstream in the sheet conveyance direction D1—that is, from the right side to the left side of the image forming apparatus 1—in an order: black heads 110*k*, cyan heads 110*c*, magenta heads 110*m*, yellow heads 110*y*. Although not illustrated in FIG. 5, the conveyance device 301 is located below the head unit 100.

Figure 6:
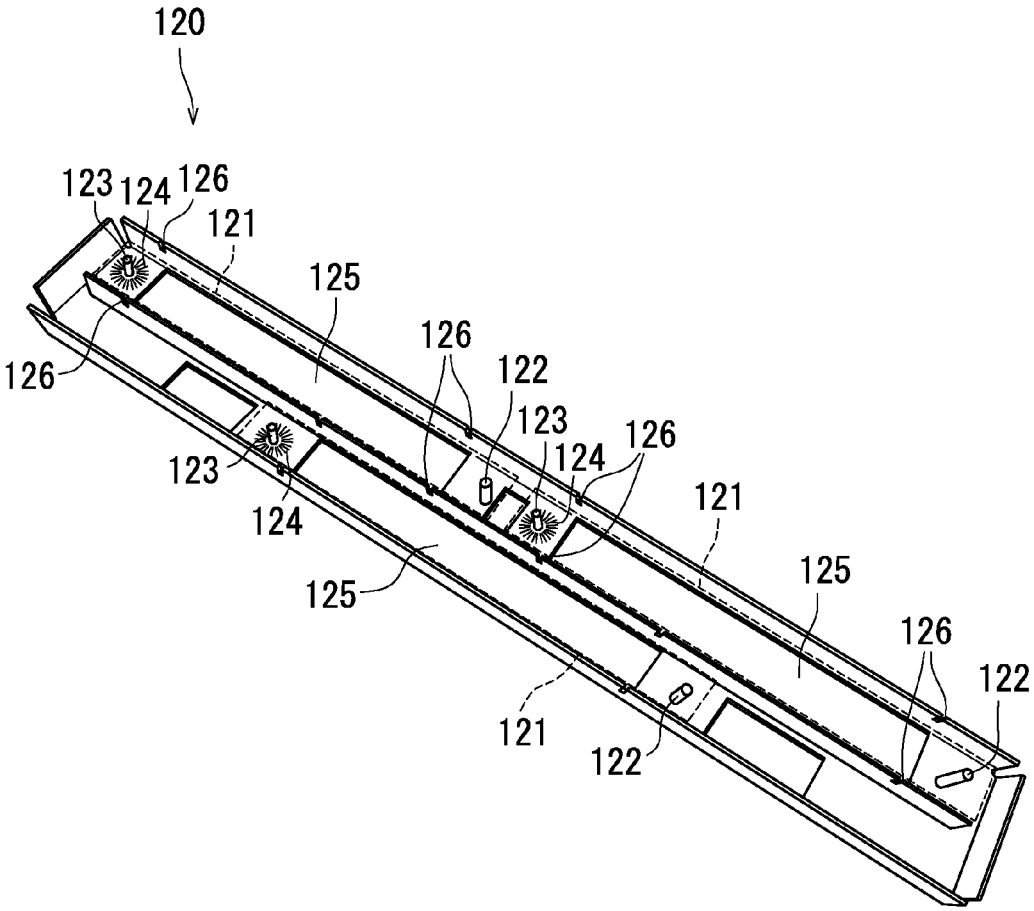
FIG. 6 is a perspective view illustrating a head base according to the embodiment of the present invention.

FIG. 6 is a perspective view illustrating a head base 120 according to the present embodiment.

FIG. 6 is a perspective view seeing the base 120 from above and illustrates configuration of a non-facing side of the base 120. The base 120 is housed in the head unit 100 such that a longitudinal direction of the base 120 corresponds to the front-back direction of the head unit 100.

A plurality (three in the present embodiment) of head attachment sections 121 are provided on the base 120. One of the heads 110 is attached to each of the head attachment sections 121. A position determining section 122 is provided at one end of each of the head attachment sections 121 in a longitudinal direction thereof and a shaft section 123 is provided at the other end of each of the head attachment sections 121 in the longitudinal direction thereof. The position determining sections 122 and the shaft sections 123 are, for example, cylindrical protrusions. A cam pin 130 (refer to FIG. 10, etc.) is attached to each of the shaft sections 123. Each of the cam pins 130 is an adjustment mechanism that adjusts the position of a corresponding head 110 attached to the base 120.

A plurality of first grooves 124 are provided radially around each of the shaft sections 123 of the base 120. A rectangular opening 125 is provided between the position determining section 122 and the shaft section 123 in each of the head attachment sections 121. When heads 110 are attached to the base 120, a nozzle case 116 (refer to FIG. 8) of each of the heads 110 protrudes through the corresponding opening 125 to the facing side of the base 120. A plurality of restricting grooves 126 are provided at specific positions on three side plates of the base 120 that extend in the longitudinal direction of the base 120.

Figure 7:
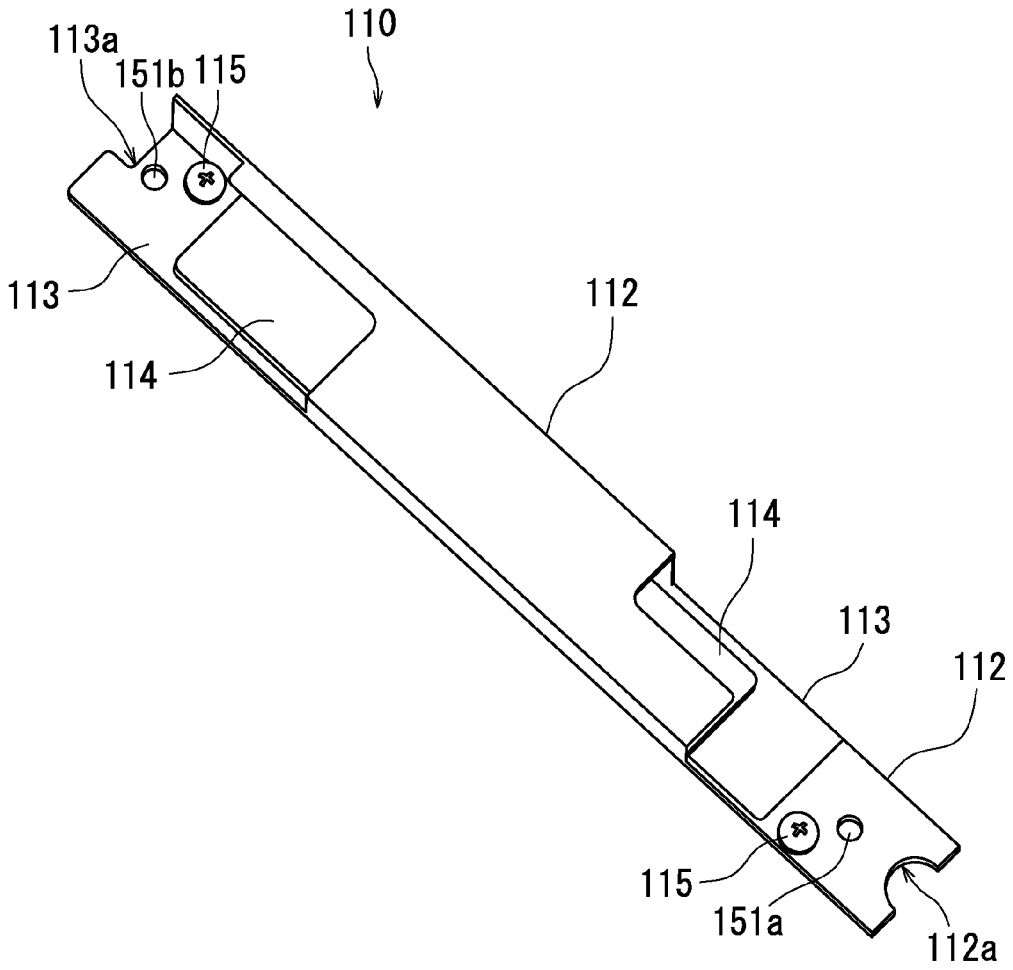
FIG. 7 is a first perspective view illustrating a recording head according to the embodiment of the present invention.
Figure 9:
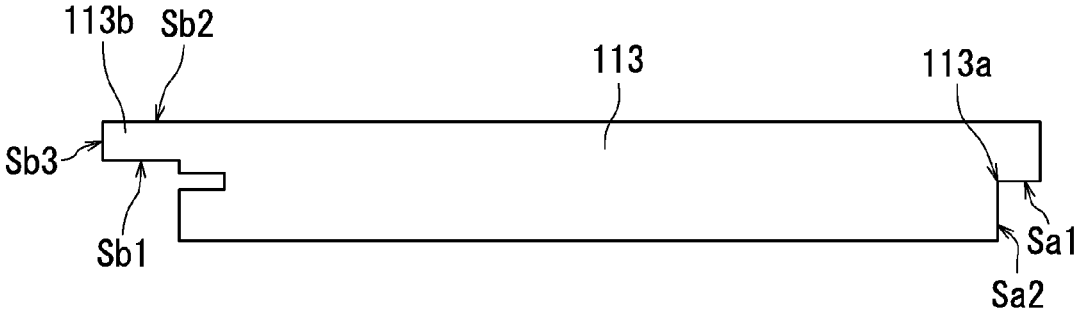
FIG. 9 is a plan view illustrating a nozzle plate according to the embodiment of the present invention.

FIG. 7 is a first perspective view illustrating a recording head 110 according to the present embodiment. FIG. 8 is a second perspective view illustrating the recording head 110 according to the present embodiment. FIG. 9 is a plan view illustrating a nozzle plate 113 according to the present embodiment.

The first perspective view in FIG. 7 is a view seeing the head 110 from above and illustrates configuration of the non-facing side of the head 110. The second perspective view in FIG. 8 is a view seeing the head 110 from below and illustrates configuration of the facing side of the head 110. The following explains configuration of the head 110 with reference to FIGS. 7-9.

The head 110 includes a heat-dissipating plate 112, a nozzle plate 113, a substrate 114, and a nozzle case 116. The nozzle case 116 houses four nozzle units 111 such that nozzle orifices 111*a* of the nozzle units 111 are exposed. The nozzle case 116 is attached to a facing side of the nozzle plate 113. The substrate 114 for example has a control circuit thereon for controlling ejection of ink droplets.

An end section of the heat-dissipating plate 112 at one end of the head 110 in the longitudinal direction (bottom-right in FIG. 7 and top-right in FIG. 8, referred to below as a "first end") has a semicircular notch 112*a* formed therein. A plurality of second grooves 117 are provided radially around the semicircular notch 112*a* on a surface at the facing side of the heat-dissipating plate 112.

A protrusion 113*b* is provided at an end section of the nozzle plate 113 at the first end. The protrusion 113*b* is a part of the end section that protrudes outward in the longitudinal direction. An end section of the nozzle plate 113 at the other end of the head 110 in the longitudinal direction (top-left in FIG. 7 and bottom-left in FIG. 8, referred to below as a "second end") has an L-shaped notch 113*a* formed therein. The L-shaped notch 113*a* is shaped like the letter L.

The following explains configuration of the nozzle plate 113 in more detail, with reference to FIG. 9. Note that the left side of FIG. 9 corresponds to the first end and the right side of FIG. 9 corresponds to the second end. The nozzle plate 113 is a plate-shaped member. The protrusion 113*b* is provided at one end section of the nozzle plate 113 in the longitudinal direction (end section at the first end). The L-shaped notch 113*a* is formed in the other end section of the nozzle plate 113 in the longitudinal direction (end section at the second end). The nozzle plate 113 has a specific thickness.

The L-shaped notch 113*a* is for example formed at one side in a lateral direction (lower side in FIG. 9 in the present embodiment) of the end section at the second end of the nozzle plate 113. The L-shaped notch 113*a* has a side surface Sa1 parallel to the longitudinal direction (surface parallel to a thickness direction) and a side surface Sa2 parallel to the lateral direction.

The protrusion 113*b* is for example provided at the other side in the lateral direction (upper side in FIG. 9 in the present embodiment) of the end section at the first end of the nozzle plate 113. The protrusion 113*b* has two side surfaces Sb1 and Sb2 that are parallel to the longitudinal direction and one side surface Sb3 that is parallel to the lateral direction. In a state in which the head 110 is attached to the base 120, the surface Sb1 is supported by a cam pin 130. Among the two side surfaces Sb1 and Sb2 that are parallel to the longitudinal direction, the surface Sb1 is closer to the center of the nozzle plate 113 in the lateral direction. The side surface Sb1 of the protrusion 113*b* that is supported by the cam pin 130 is referred to below as a "supported surface."

Referring once again to FIG. 7, a through hole 151*a* is formed at the first end of the heat-dissipating plate 112. A fastening member (a screw in the present embodiment, referred to below as a "restricting member screw") 151 (refer to FIG. 16) for attachment of a restricting member 150 passes through the through hole 151*a*. In the same way, a through hole 151*b* is formed at the second end of the nozzle plate 113. A restricting member screw 151 passes through the through hole 151*b*.

After the position of the head 110 has been adjusted relative to the base 120, the head 110 is fixed to the base 120 by, for example, fastening members (screws in the present embodiment, referred to below as "head screws") 115 at both ends in the longitudinal direction.

Next, configuration and function of the cam pin 130, which is one example of the adjustment mechanism according to the present embodiment, are explained with reference to FIGS. 10-15.

Figure 10:
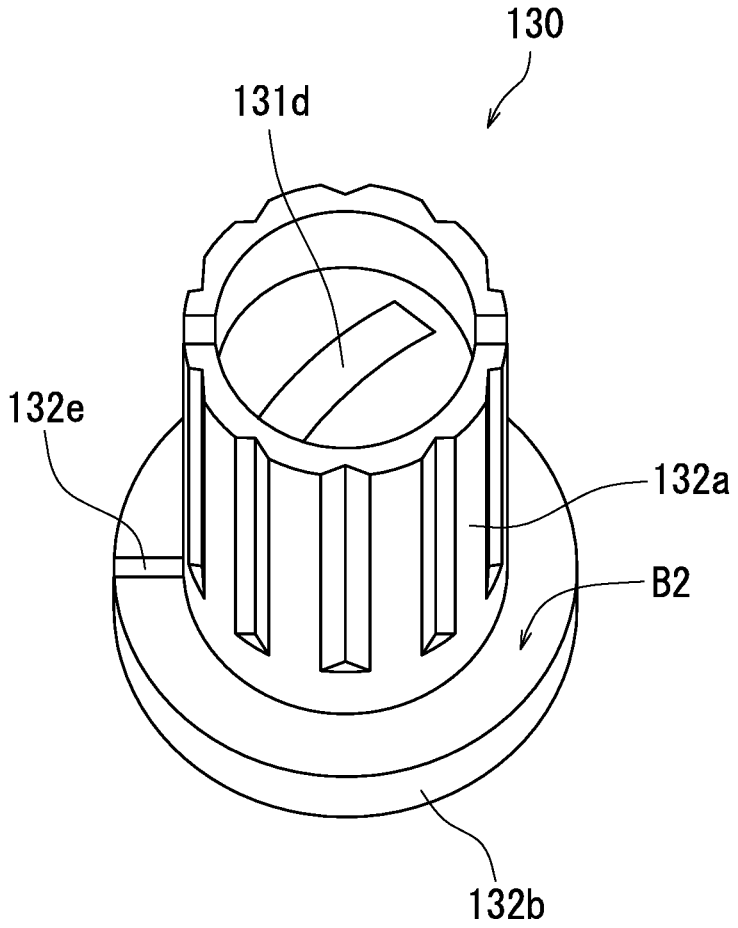
FIG. 10 is a perspective view illustrating a cam pin according to the embodiment of the present invention.
Figure 11:
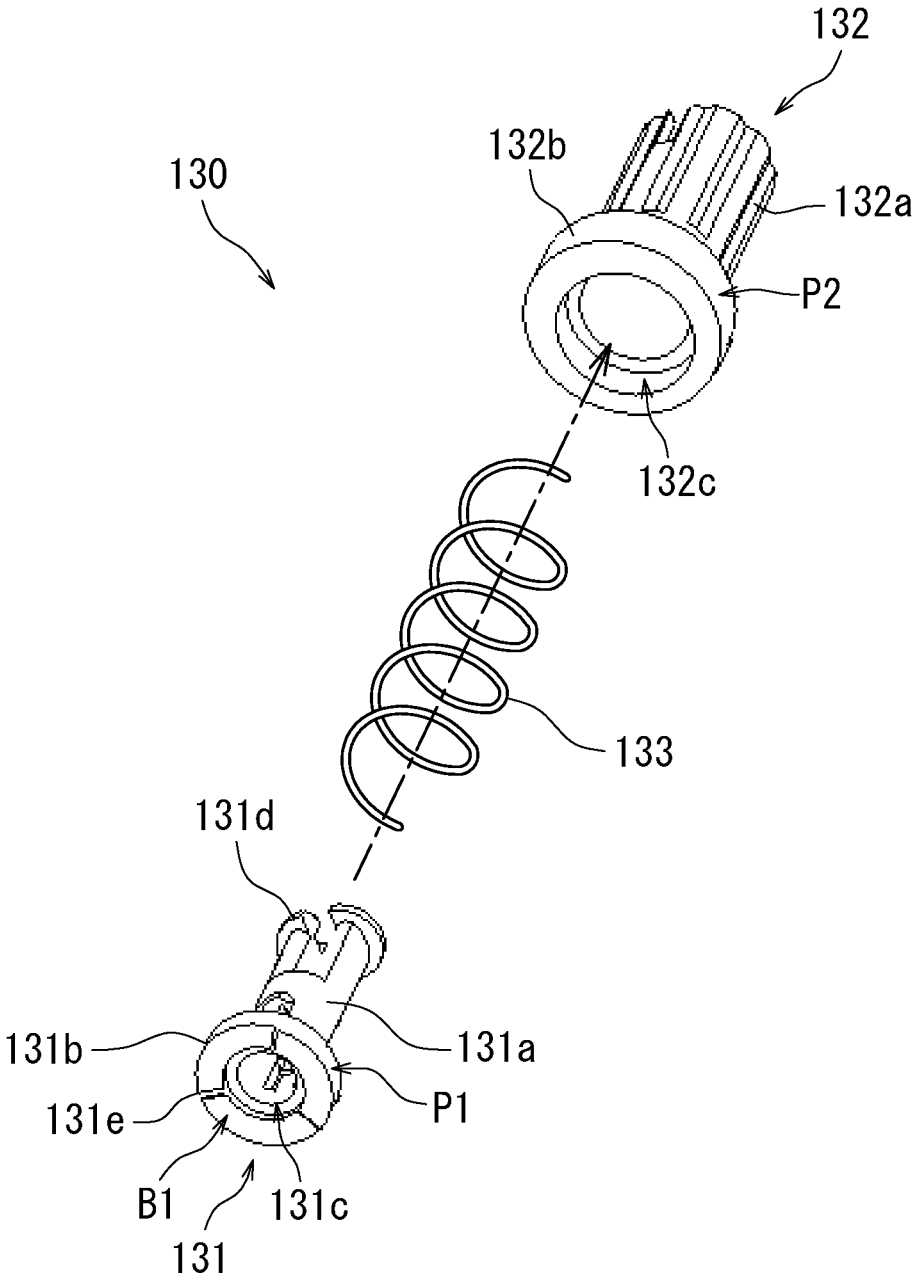
FIG. 11 is an exploded view illustrating the cam pin according to the embodiment of the present invention.
Figure 12:
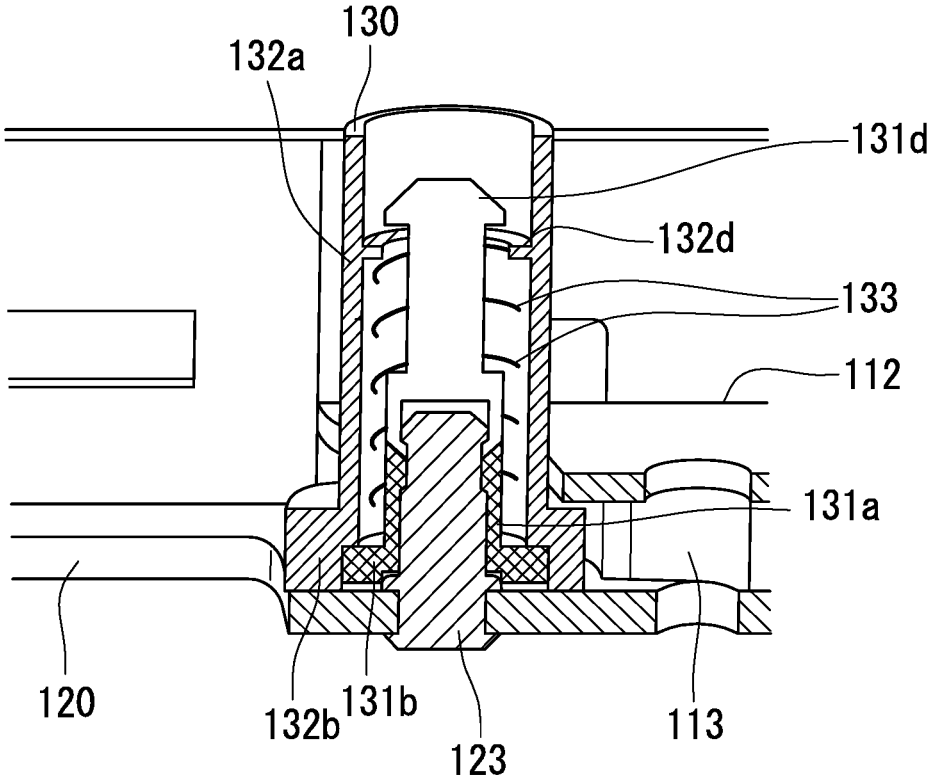
FIG. 12 is a cross-sectional view illustrating the cam pin according to the embodiment of the present invention.
Figure 13:
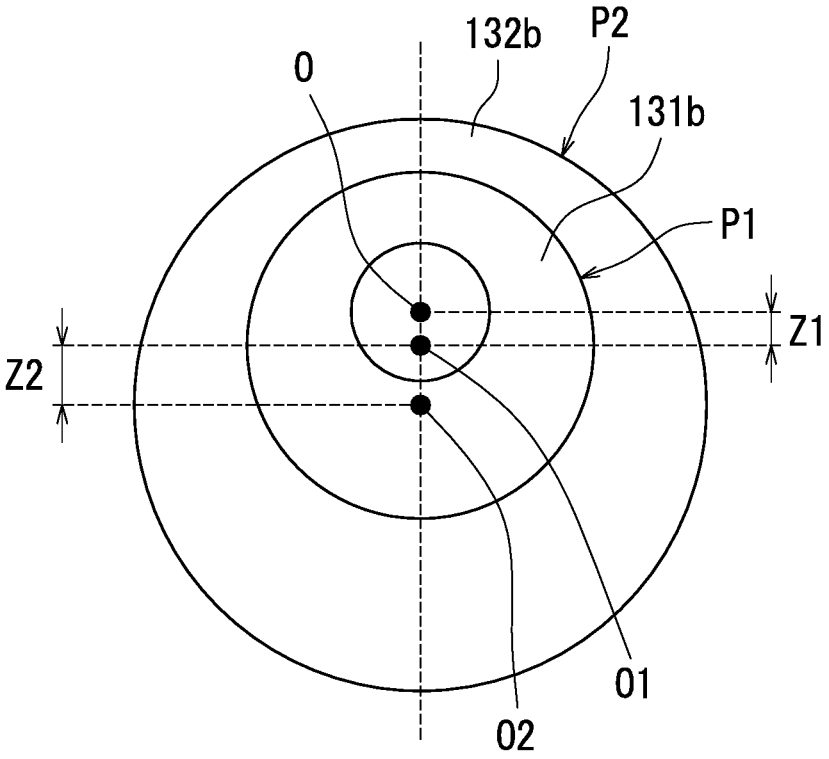
FIG. 13 is a bottom surface view illustrating the cam pin according to the embodiment of the present invention.

FIG. 10 is a perspective view illustrating the cam pin 130 according to the present embodiment. FIG. 11 is an exploded view illustrating the cam pin 130 according to the present embodiment. FIG. 12 is a cross-sectional view illustrating the cam pin 130 according to the present embodiment. FIG. 13 is a bottom surface view illustrating the cam pin 130 according to the present embodiment.

The cam pin 130 is an adjustment mechanism. The adjustment mechanism adjusts a position of a target object attached to an attachment base. In the present embodiment, the attachment base is the base 120 and the target object is the head 110. As illustrated in FIGS. 10 and 11, the cam pin 130 includes an inner cam 131 (first cam), an outer cam 132 (second cam), and a biasing member 133. The inner cam 131 is internally housed by the outer cam 132. The cam pin 130 is attached to the base 120 through attachment of the inner cam 131 to the shaft section 123 of the base 120. The inner cam 131, the outer cam 132, and the biasing member 133 for example have an integrated structure and the inner cam 131, the outer cam 132, and the biasing member 133 are for example integrally attached to the base 120 through attachment of the inner cam 131 to the shaft section 123.

The following explains configuration of the inner cam 131 with reference to FIG. 11. The inner cam 131 causes displacement of the head 110 via the outer cam 132 by rotating about the shaft section 123 as a rotational axis. The inner cam 131 includes a first eccentric cam member 131*b* and a first operation section 131*a*.

The first eccentric cam member 131*b* is for example a cylindrical (circular plate-shaped in the present embodiment) member. A first fitting hole 131*c* is formed in the first eccentric cam member 131*b*. The first fitting hole 131*c* fits slidably with the shaft section 123. The first eccentric cam member 131*b* is rotatable about the shaft section 123 fitted into the first fitting hole 131*c* as a rotational axis.

A bottom surface B1 of the first eccentric cam member 131*b* (bottom surface on a near side of FIG. 11) is referred to below as a "first base-facing surface" (first bottom surface). Among two bottom surfaces of the first eccentric cam member 131*b*, the bottom surface B1 is a bottom surface that is on a side facing the base 120 while the cam pin 130 is attached to the base 120. The other bottom surface of the first eccentric cam member 131*b* (bottom surface on a far side of FIG. 11) is referred to below as a "first non-base-facing surface." Among the two bottom surfaces of the first eccentric cam member 131*b*, the aforementioned bottom surface is a bottom surface that is on a side not facing the base 120 and thus is a bottom surface that is not the first base-facing surface B1.

The first operation section 131*a* receives a first operation that rotates the first eccentric cam member 131*b*. The first operation section 131*a* is for example a circular tube-shaped member. One end of the first operation section 131*a* in an axial direction thereof is connected to the first non-base-facing surface of the first eccentric cam member 131*b*. On the other hand, the other end of the first operation section 131*a* in the axial direction is split into two parts by slits. A first engaging section 131*d* is provided at the other end of the first operation section 131*a* in the axial direction. The first engaging section 131*d* engages with the outer cam 132.

As illustrated in FIG. 13, the first eccentric cam member 131*b* has a central axis O1 and the rotational axis (shaft section 123) of the first eccentric cam member 131*b* has an axial center O. The central axis O1 is separated from the axial center O by a specific first distance Z1. In other words, the inner cam 131 is an eccentric cam that is offset by the first distance Z1. Therefore, rotation of the inner cam 131 results in displacement of an outer circumferential surface P1 of the inner cam 131. In other words, the outer circumferential surface P1 of the first eccentric cam member 131*b* is displaced by rotation of the first eccentric cam member 131*b* based on the first operation. Consequently, the outer circumferential surface P1 of the inner cam 131 causes displacement of the outer cam 132 (second eccentric cam member 132*b*) and causes displacement of the head 110, which is supported by an outer circumferential surface P2 of the outer cam 132.

The following explains configuration of the outer cam 132 with reference to FIGS. 10 and 11. The outer cam 132 internally houses the inner cam 131 and supports the head 110. The outer cam 132 displaces the head 110 by rotating about the inner cam 131 as a rotational axis. The outer cam 132 includes a second eccentric cam member 132*b* and a second operation section 132*a*.

The second eccentric cam member 132*b* is for example a cylindrical (circular plate-shaped in the present embodiment) member. A second fitting hole 132*c* is formed in the second eccentric cam member 132*b*. The second fitting hole 132*c* is slidably fitted with the first eccentric cam member 131*b*. The second eccentric cam member 132*b* rotates about the inner cam 131 (more specifically, the first eccentric cam member 131*b*) as a rotational axis. The inner cam 131 is fitted into the second fitting hole 132*c*.

One bottom surface of the second eccentric cam member 132*b* (bottom surface on the near side of FIG. 11) is referred to below as a "second base-facing surface." Among two bottom surfaces of the second eccentric cam member 132*b*, the aforementioned bottom surface is a bottom surface that is on a side facing the base 120 while the cam pin 130 is attached to the base 120. On the other hand, a bottom surface B2 of the second eccentric cam member 132*b* (bottom surface on the far side of FIG. 11) is referred to below as a "second non-base-facing surface" (second bottom surface). Among the two bottom surfaces of the second eccentric cam member 132*b*, the aforementioned bottom surface is a bottom surface that is on a side not facing the base 120 and thus is a bottom surface that is not the second base-facing surface.

The second operation section 132*a* receives a second operation that rotates the second eccentric cam member 132*b*. The second operation section 132*a* is for example a circular tube-shaped member. One end of the second operation section 132*a* in an axial direction thereof is connected to the second non-base-facing surface B2 of the second eccentric cam member 132*b*. As illustrated in FIG. 12, a second engaging section 132*d* is provided inside of the second operation section 132*a*, toward the other end of the second operation section 132*a* in the axial direction. The second engaging section 132*d* engages with the first engaging section 131*d* of the inner cam 131.

As illustrated in FIG. 13, the second eccentric cam member 132*b* has a central axis O2 and the rotational axis (inner cam 131) of the second eccentric cam member 132*b* has an axial center O1. The central axis O2 is separated from the axial center O1 by a specific second distance Z2. In other words, the outer cam 132 is an eccentric cam that is offset by the second distance Z2. Therefore, rotation of the outer cam 132 results in displacement of the outer circumferential surface P2 of the outer cam 132. In other words, the outer circumferential surface P2 of the second eccentric cam member 132*b* is displaced by rotation of the second eccentric cam member 132*b* based on the second operation. Consequently, the outer circumferential surface P2 of the second eccentric cam member 132*b* displaces the head 110 supported by the outer circumferential surface P2.

In the present embodiment, the offset of the inner cam 131—that is, the offset (first distance Z1) of the first eccentric cam member 131*b*—differs from the offset of the outer cam 132—that is, the offset (second distance Z2) of the second eccentric cam member 132*b*. More specifically, the offset (first distance Z1) of the first eccentric cam member 131*b* is smaller than the offset (second distance Z2) of the second eccentric cam member 132*b*. Therefore, an amount of displacement of the outer circumferential surface P2 resulting from rotation of the first eccentric cam member 131*b* is smaller than an amount of displacement of the outer circumferential surface P2 resulting from rotation of the second eccentric cam member 132*b*. More specifically, an amount of displacement of the outer circumferential surface P1 of the first eccentric cam member 131*b* during one rotation of the first eccentric cam member 131*b* and an amount of displacement of the outer circumferential surface P2 of the second eccentric cam member 132*b* resulting from the aforementioned displacement of the outer circumferential surface P1 are smaller than an amount of displacement of the outer circumferential surface P2 of the second eccentric cam member 132*b* during one rotation of the second eccentric cam member 132*b*.

Figure 14:
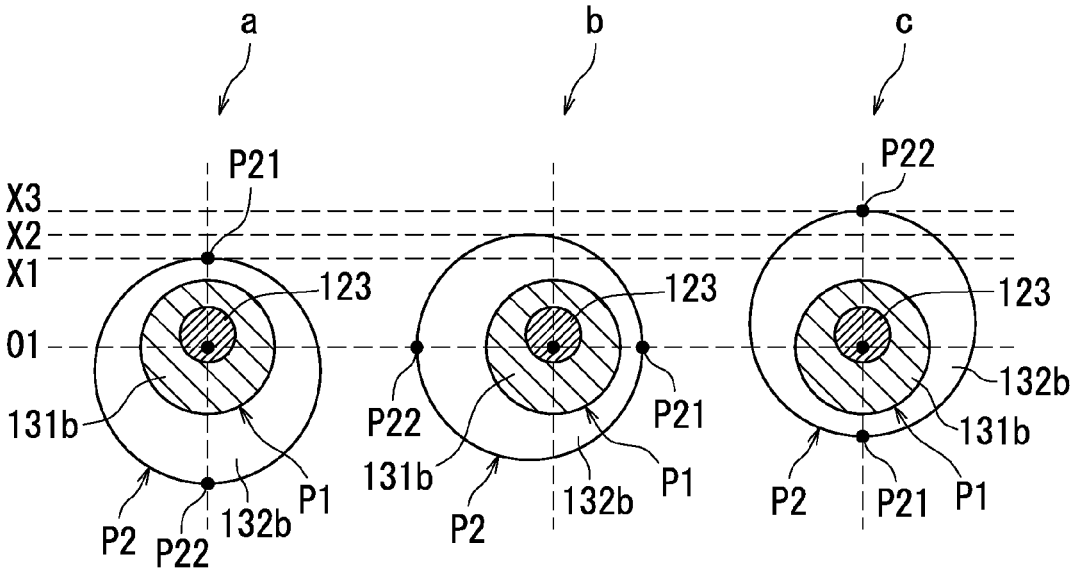
FIG. 14 illustrates change in position of an outer circumferential surface of the cam pin resulting from rotation of an outer cam.
Figure 15:
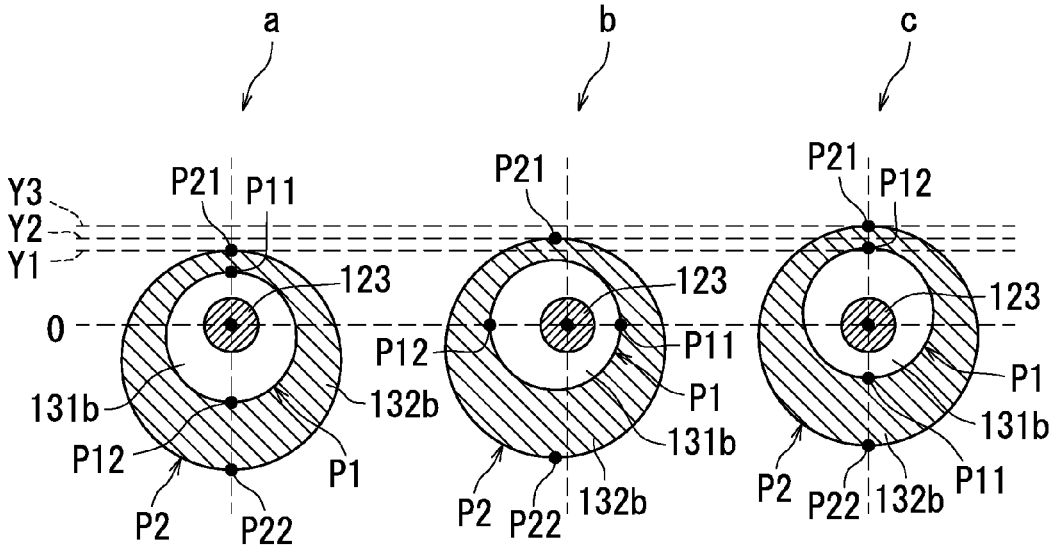
FIG. 15 illustrates change in position of the outer circumferential surface of the cam pin resulting from rotation of an inner cam.

The following explains change in position of an outer circumferential surface of the cam pin 130 resulting from rotation of the outer cam 132 and the inner cam 131 with reference to FIGS. 14 and 15. Note that the outer circumferential surface of the cam pin 130 is the outer circumferential surface P2 of the second eccentric cam member 132*b*.

FIG. 14 illustrates change in position of the outer circumferential surface of the cam pin 130 resulting from rotation of the outer cam 132. FIG. 15 illustrates change in position of the outer circumferential surface of the cam pin 130 resulting from rotation of the inner cam 131.

In the following explanation of FIGS. 14 and 15, upward, downward, rightward, and leftward in FIGS. 14 and 15 are referred to simply as "upward", "downward", "rightward", and "leftward." Furthermore, clockwise and counterclockwise directions in FIGS. 14 and 15 are referred to simply as a "clockwise direction" and a "counterclockwise direction."

In the following explanation, a position on the outer circumferential surface P1 or P2 of the first eccentric cam member 131*b* or the second eccentric cam member 132*b* that is closest to the axial center O or O1 of the rotational axis of the eccentric cam member 131*b* or 132*b* is referred to as an "innermost position." Furthermore, a position on the outer circumferential surface P1 or P2 of the first eccentric cam member 131*b* or the second eccentric cam member 132*b* that is furthest from the axial center O or O1 of the rotational axis of the eccentric cam member 131*b* or 132*b* is referred to as an "outermost position." A position on the outer circumferential surface P1 of the first eccentric cam member 131*b* that is furthest upward is referred to as a "first-cam uppermost position." A position on the outer circumferential surface P2 of the second eccentric cam member 132*b* that is furthest upward is referred to as a "second-cam uppermost position."

State a in FIG. 14 illustrates a state (referred to below as a "first state") in which an innermost position P21 of the second eccentric cam member 132*b* is located at the second-cam uppermost position. In the first state, the second-cam uppermost position is a position X1.

State b in FIG. 14 illustrates a state (referred to below as a "second state") after the second eccentric cam member 132*b* has rotated 90° in the clockwise direction from the first state.

Through the second eccentric cam member 132*b* rotating 90° in the clockwise direction from the first state, the innermost position P21 moves from the second-cam uppermost position to a furthest rightward position on the outer circumferential surface P2. Consequently, the second-cam uppermost position X2 in the second state is further upward than the second-cam uppermost position X1 in the first state. In other words, rotation of the second eccentric cam member 132*b* by 90° in the clockwise direction from the first state results in the second-cam uppermost position being displaced upward from the position X1 to the position X2.

State c in FIG. 14 illustrates a state (referred to below as a "third state") after the second eccentric cam member 132*b* has rotated 90° further in the clockwise direction from the second state.

Through the second eccentric cam member 132*b* rotating 90° further in the clockwise direction from the second state, the innermost position P21 moves from the furthest rightward position to a furthest downward position on the outer circumferential surface P2. Meanwhile, the outermost position P22 of the second eccentric cam member 132*b* becomes located at the second-cam uppermost position. Consequently, the second-cam uppermost position X3 in the third state is further upward than the second-cam uppermost position X2 in the second state. In other words, rotation of the second eccentric cam member 132*b* by 90° in the clockwise direction from the second state results in the second-cam uppermost position being displaced upward from the position X2 to the position X3.

Although not illustrated, upon the second eccentric cam member 132*b* rotating 90° further in the clockwise direction from the third state, the innermost position P21 moves to a furthest leftward position on the outer circumferential surface P2 and the second-cam uppermost position returns to the position X2. In other words, the second-cam uppermost position is displaced downward from the position X3 to the position X2. Upon the second eccentric cam member 132*b* rotating 90° further in the clockwise direction, the second eccentric cam member 132*b* returns to the first state illustrated by state a in FIG. 14. In other words, the second-cam uppermost position is displaced downward from the position X2 to the position X1.

Upon the second eccentric cam member 132*b* rotating 90° in the counterclockwise direction from the third state, the second eccentric cam member 132*b* returns to the second state illustrated by state b in FIG. 14. In other words, the second-cam uppermost position is displaced downward from the position X3 to the position X2. Upon the second eccentric cam member 132*b* rotating 90° in the counterclockwise direction from the second state, the second eccentric cam member 132*b* returns to the first state illustrated by state a in FIG. 14. In other words, the second-cam uppermost position is displaced downward from the position X2 to the position X1.

Rotation of the second eccentric cam member 132*b* results in upward or downward displacement of the second-cam uppermost position as described above. Therefore, in a configuration in which, for example, the cam pin 130 supports the head 110 at the second-cam uppermost position, upward displacement of the second-cam uppermost position through rotation of the second eccentric cam member 132*b* causes upward displacement of a position of the head 110. If the head 110 is for example biased toward the cam pin 130 in the configuration in which the cam pin 130 supports the head 110 at the second-cam uppermost position, downward displacement of the second-cam uppermost position through rotation of the second eccentric cam member 132*b* causes downward displacement of the position of the head 110. Therefore, a person (adjustor) who attaches the head 110 to the base 120 and adjusts the position of the head 110 can adjust the position of the head 110 supported by the cam pin 130 by rotating of the second eccentric cam member 132*b* of the cam pin 130.

State a in FIG. 15 illustrates a state (referred to below as a "fourth state") in which an innermost position P11 of the first eccentric cam member 131*b* is located at the first-cam uppermost position. In the fourth state, the second-cam uppermost position is a position Y1. In the example illustrated in FIG. 15, the second eccentric cam member 132*b* is in a state in which the innermost position P21 of the second eccentric cam member 132*b* is located at the second-cam uppermost position; in other words, the second eccentric cam member 132*b* is in the first state.

State b in FIG. 15 illustrates a state (referred to below as a "fifth state") after the first eccentric cam member 131*b* has rotated 90° in the clockwise direction from the fourth state.

Through the first eccentric cam member 131*b* rotating 90° in the clockwise direction from the fourth state, the innermost position P11 moves from the first-cam uppermost position to a furthest rightward position on the outer circumferential surface P1. During rotation, the first eccentric cam member 131*b* slides against an inner circumferential surface of the second eccentric cam member 132*b* (circumferential surface of the second fitting hole 132*c*). Therefore, the second eccentric cam member 132*b* remains in the first state or a similar state to the first state. Consequently, the second-cam uppermost position Y2 in the fifth state is further upward than the second-cam uppermost position Y1 in the fourth state. In other words, rotation of the first eccentric cam member 131*b* by 90° in the clockwise direction from the fourth state results in the second-cam uppermost position being displaced upward from the position Y1 to the position Y2.

Herein, the offset (first distance Z1) of the first eccentric cam member 131*b* is smaller than the offset (second distance Z2) of the second eccentric cam member 132*b*. Consequently, an amount of displacement of the outer circumferential surface P2 of the second eccentric cam member 132*b* resulting from rotation of the first eccentric cam member 131*b* is smaller than an amount of displacement of the outer circumferential surface P2 of the second eccentric cam member 132*b* resulting from rotation of the second eccentric cam member 132*b*. Therefore, an amount of displacement of the second-cam uppermost position when the first eccentric cam member 131*b* rotates 90° in the clockwise direction from the fourth state—that is, an amount of displacement from the position Y1 to the position Y2—is smaller than an amount of displacement of the second-cam uppermost position when the second eccentric cam member 132*b* rotates 90° in the clockwise direction from the first state—that is, an amount of displacement from the position X1 to the position X2.

Note that due to frictional resistance between the outer circumferential surface P1 of the first eccentric cam member 131*b* and the inner circumferential surface of the second eccentric cam member 132*b*, the second eccentric cam member 132*b* may rotate slightly as a result of rotation of the first eccentric cam member 131*b*.

State c in FIG. 15 illustrates a state (referred to below as a "sixth state") after the first eccentric cam member 131*b* has rotated 90° further in the clockwise direction from the fifth state.

Through the first eccentric cam member 131*b* rotating 90° further in the clockwise direction from the fifth state, the innermost position P11 moves from the furthest rightward position to a furthest downward position on the outer circumferential surface P1. Meanwhile, the outermost position P12 of the first eccentric cam member 131*b* becomes located at the first-cam uppermost position. As explained above, the first eccentric cam member 131*b* slides against the inner circumferential surface of the second eccentric cam member 132*b* (circumferential surface of the second fitting hole 132*c*) such that the second eccentric cam member 132*b* remains in the first state or a similar state to the first state. Consequently, the second-cam uppermost position Y3 in the sixth state is further upward than the second-cam uppermost position Y2 in the fifth state. In other words, rotation of the first eccentric cam member 131*b* by 90° further in the clockwise direction from the fifth state results in the second-cam uppermost position being displaced upward from the position Y2 to the position Y3.

As explained above, an amount of displacement of the outer circumferential surface P2 resulting from rotation of the first eccentric cam member 131*b* is smaller than an amount of displacement of the outer circumferential surface P2 resulting from rotation of the second eccentric cam member 132*b*. Therefore, an amount of displacement of the second-cam uppermost position when the first eccentric cam member 131*b* rotates 90° in the clockwise direction from the fifth state—that is, an amount of displacement from the position Y2 to the position Y3—is smaller than an amount of displacement of the second-cam uppermost position when the second eccentric cam member 132*b* rotates 90° in the clockwise direction from the second state—that is, an amount of displacement from the position X2 to the position X3.

Although not illustrated, upon the first eccentric cam member 131*b* rotating 90° further in the clockwise direction from the sixth state, the innermost position P11 moves to a furthest leftward position on the outer circumferential surface P1 and the second-cam uppermost position returns to the position Y2. In other words, the second-cam uppermost position is displaced downward from the position Y3 to the position Y2. Upon the first eccentric cam member 131*b* rotating 90° further in the clockwise direction, the first eccentric cam member 131*b* returns to the fourth state illustrated by state a in FIG. 15. In other words, the second-cam uppermost position is displaced downward from the position Y2 to the position Y1.

Upon the first eccentric cam member 131*b* rotating 90° in the counterclockwise direction from the sixth state, the first eccentric cam member 131*b* returns to the fifth state illustrated by state b in FIG. 15. In other words, the second-cam uppermost position is displaced downward from the position Y3 to the position Y2. Upon the first eccentric cam member 131*b* rotating 90° in the counterclockwise direction from the fifth state, the first eccentric cam member 131*b* returns to the fourth state illustrated by state a in FIG. 15. In other words, the second-cam uppermost position is displaced downward from the position Y2 to the position Y1.

Rotation of the first eccentric cam member 131*b* results in upward or downward displacement of the second-cam uppermost position as described above. Therefore, in a configuration in which, for example, the cam pin 130 supports the head 110 at the second-cam uppermost position, upward displacement of the second-cam uppermost position through rotation of the first eccentric cam member 131*b* causes upward displacement of the position of the head 110. If the head 110 is for example biased toward the cam pin 130 in the configuration in which the cam pin 130 supports the head 110 at the second-cam uppermost position, downward displacement of the second-cam uppermost position through rotation of the first eccentric cam member 131*b* causes downward displacement of the position of the head 110. Therefore, the adjustor can adjust the position of the head 110 supported by the cam pin 130 by rotating the first eccentric cam member 131*b* of the cam pin 130.

An amount of displacement of the outer circumferential surface P2 resulting from rotation of the first eccentric cam member 131*b* is smaller than an amount of displacement of the outer circumferential surface P2 resulting from rotation of the second eccentric cam member 132*b*. Consequently, the adjustor can adjust the position of the head 110 more precisely by rotating the first eccentric cam member 131*b* than by rotating the second eccentric cam member 132*b*. Therefore, the adjustor can make adjustments involving relatively large movements (rough adjustments) of the position of the head 110 by rotating the second eccentric cam member 132*b* and can perform adjustments involving relatively small movements (fine adjustments) of the position of the head 110 by rotating the first eccentric cam member 131*b*. The above configuration enables the adjustor to precisely adjust the position of the recording head to an optimal position.

The following explains configuration and function of the biasing member 133 with reference to FIGS. 10-12.

As illustrated in FIG. 12, the biasing member 133 biases the first base-facing surface B1 of the first eccentric cam member 131*b* toward the base 120 and biases the second non-base-facing surface B2 of the second eccentric cam member 132*b* toward a covering section (heat-dissipating plate 112) of the head 110. The biasing member 133 is for example an elastic coil spring. Herein, the covering section is a section of the head 110 that covers the second non-base-facing surface B2. In the present embodiment, the covering section is the end section at the first end of the heat-dissipating plate 112 and thus is the end section at which the semicircular notch 112*a* is formed.

The biasing member 133 biases the inner cam 131 and the outer cam 132 in directions away from one another. However, engagement between the first engaging section 131*d* of the inner cam 131 and the second engaging section 132*d* of the outer cam 132 inhibits the inner cam 131 and the outer cam 132 from separating from one another and thus maintains a state in which the inner cam 131 is housed in the outer cam 132.

As explained above, the plurality of first grooves 124 is provided radially around the shaft section 123 of the base 120. Furthermore, a first protrusion 131*e* is provided on the first base-facing surface B1 of the first eccentric cam member 131*b*. Biasing force received from the biasing member 133 by the first eccentric cam member 131*b* causes the first protrusion 131*e* to move into one of the first grooves 124. The first grooves 124 are located opposite to the first protrusion 131*e*. The first protrusion 131*e* moves into the first grooves 124 in order as the first eccentric cam member 131*b* rotates.

An interval between two adjacent first grooves 124 among the plurality of first grooves 124 is for example set based on an amount of displacement of the head 110 resulting from rotation of the first eccentric cam member 131*b*. For example, the interval between the two adjacent first grooves 124 is set such that the amount of displacement of the head 110 resulting from rotation of the first eccentric cam member 131*b* by an angle between the two adjacent first grooves 124 is a specific first value (for example, 0.01 mm). Through the above configuration, the plurality of first grooves 124 functions as a scale that indicates an amount of displacement of the head 110 and an amount of rotation of the first eccentric cam member 131*b* when the first eccentric cam member 131*b* rotates.

When the first protrusion 131*e* moves into any of the first grooves 124, the first eccentric cam member 131*b* moves slightly in a direction toward the base 120. Conversely, when the first protrusion 131*e* moves out of any of the first grooves 124, the first eccentric cam member 131*b* moves slightly in an opposite direction to the direction toward the base 120. Therefore, when the operator rotates the first eccentric cam member 131*b*, the operator can sense the operation (first operation) through touch. Through the above, the operator can easily perceive to what extent the first eccentric cam member 131*b* has been rotated, which facilitates adjustment of the position of the head 110.

As explained above, the plurality of second grooves 117 is formed radially around the semicircular notch 112*a* in a surface of the covering section (end section at the first end of the heat-dissipating plate 112) opposite to the second non-base-facing surface B2. Furthermore, a second protrusion 132*e* is provided on the second non-base-facing surface B2 of the second eccentric cam member 132*b* as illustrated in FIG. 10. Biasing force received from the biasing member 133 by the second eccentric cam member 132*b* causes the second protrusion 132*e* to move into one of the second grooves 117. The second grooves 117 are located opposite to the second protrusion 132*e*. The second protrusion 132*e* moves into the second grooves 117 in order as the second eccentric cam member 132*b* rotates.

An interval between two adjacent second grooves 117 among the plurality of second grooves 117 is for example set based on an amount of displacement of the head 110 resulting from rotation of the second eccentric cam member 132*b*. For example, the interval between the two adjacent second grooves 117 is set such that the amount of displacement of the head 110 resulting from rotation of the second eccentric cam member 132*b* by an angle between the two adjacent second grooves 117 is a specific second value. The second value is for example set as a larger value (for example, 0.2 mm) than the first value. Through the above configuration, the plurality of second grooves 117 functions as a scale that indicates an amount of displacement of the head 110 and an amount of rotation of the second eccentric cam member 132*b* when the second eccentric cam member 132*b* rotates.

When the second protrusion 132*e* moves into any of the second grooves 117, the second eccentric cam member 132*b* moves slightly in the opposite direction to the direction toward the base 120. Conversely, when the second protrusion 132*e* moves out of any of the second grooves 117, the second eccentric cam member 132*b* moves slightly in the direction toward the base 120. Therefore, when the operator rotates the second eccentric cam member 132*b*, the operator can sense the operation (second operation) through touch. Through the above, the operator can easily perceive to what extent the second eccentric cam member 132*b* has been rotated, which facilitates adjustment of the position of the head 110.

Note that as a result of the biasing member 133 biasing the second non-base-facing surface B2 toward the covering section, a state in which the second protrusion 132*e* is in one of the second grooves 117 is maintained during rotation of the first eccentric cam member 131*b*. In other words, the second eccentric cam member 132*b* receives biasing force from the biasing member 133 and, as a consequence, rotation of the second eccentric cam member 132*b* is restricted while the first eccentric cam member 131*b* is rotating. Therefore, a situation in which the second eccentric cam member 132*b* rotates in conjunction with rotation of the first eccentric cam member 131*b* does not occur. Furthermore, as a result of the first base-facing surface B1 being biased toward the base 120 by the biasing member 133, a state in which the first protrusion 131*e* is in one of the first grooves 124 is maintained during rotation of the second eccentric cam member 132*b*. In other words, the first eccentric cam member 131*b* receives biasing force from the biasing member 133 and, as a consequence, rotation of the first eccentric cam member 131*b* is restricted while the second eccentric cam member 132*b* is rotating. Therefore, a situation in which the first eccentric cam member 131*b* rotates in conjunction with rotation of the second eccentric cam member 132*b* does not occur.

The following explains attachment of the head 110 to the base 120 with reference to FIGS. 16-19.

Figure 16:
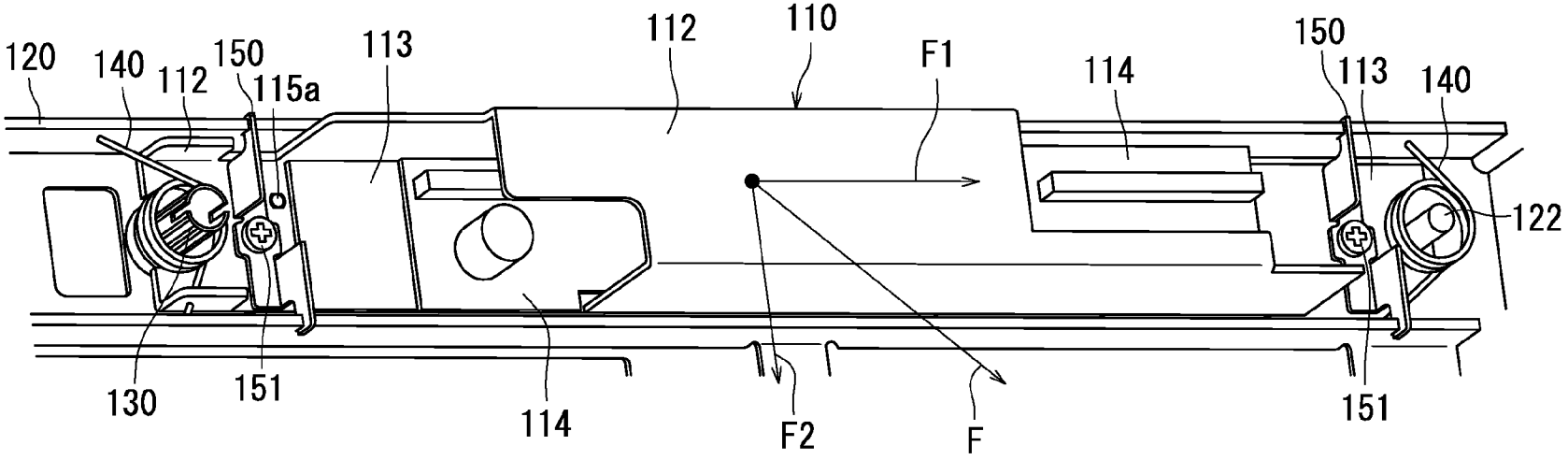
FIG. 16 is a perspective view illustrating a state in which the recording head is attached to the head base.
Figure 17:
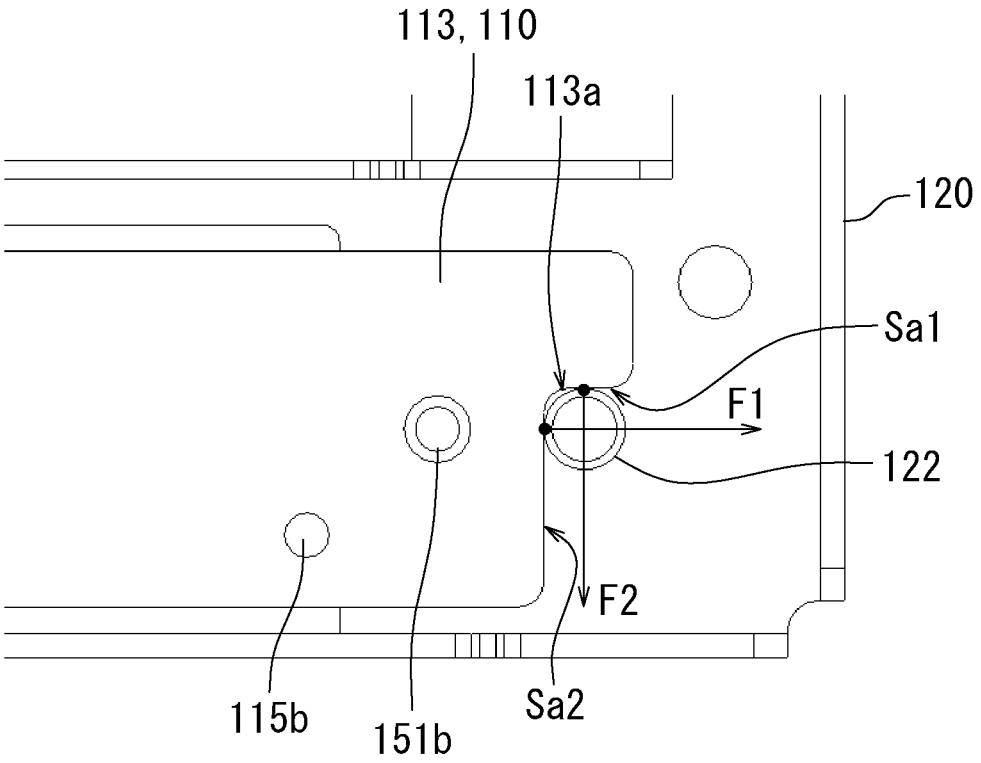
FIG. 17 illustrates configuration at a second end of the recording head attached to the head base.
Figure 18:
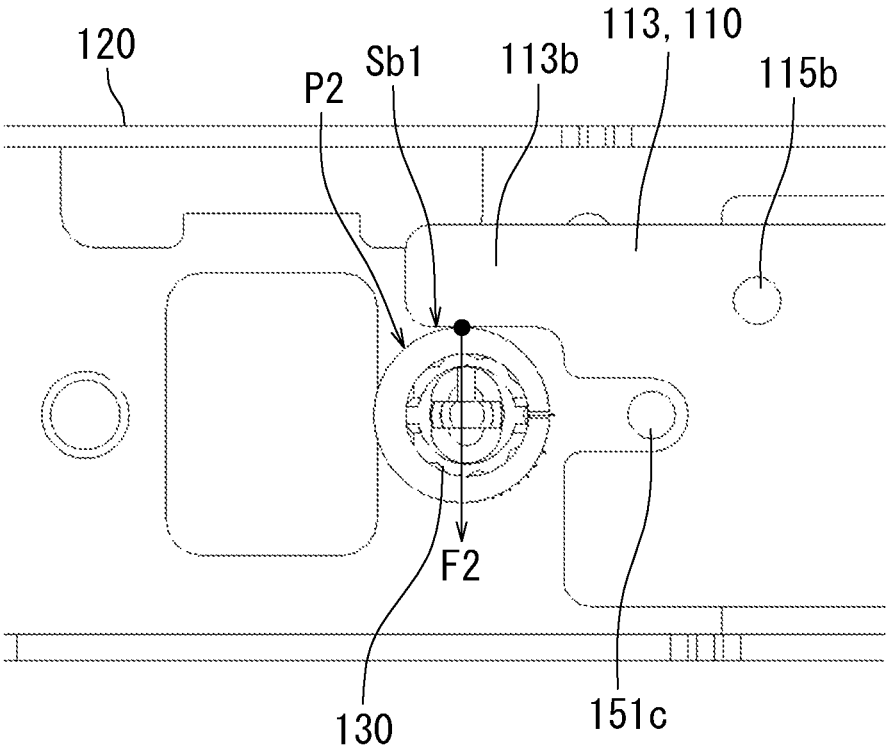
FIG. 18 illustrates configuration at a first end of the recording head attached to the head base.
Figure 19:
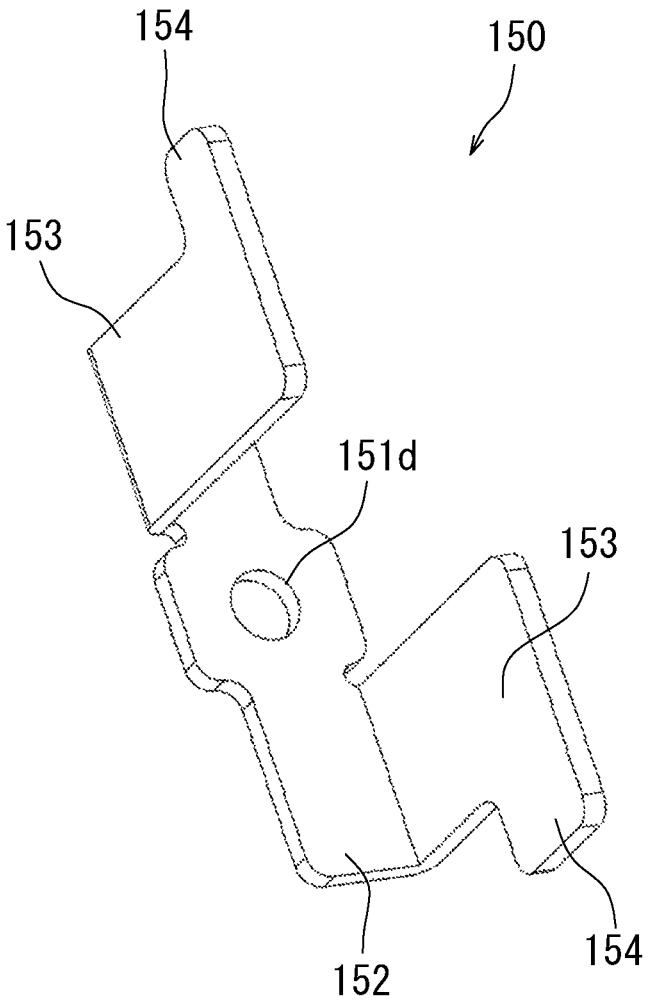
FIG. 19 is a perspective view illustrating a restricting member according to the embodiment of the present invention.

FIG. 16 is a perspective view illustrating a state in which the recording head 110 is attached to the head base 120. FIG. 17 illustrates configuration at the second end of the recording head 110 attached to the head base 120. FIG. 18 illustrates configuration at the first end of the recording head 110 attached to the head base 120. FIG. 19 is a perspective view illustrating a restricting member 150 according to the present embodiment. Note that in FIGS. 17 and 18, parts of the head 110 other than the nozzle plate 113 are omitted.

As illustrated in FIG. 16, the head 110 is attached to the base 120 such that the first end of the head 110 is positioned at the same side of the base 120 as the shaft section 123 and the second end of the head 110 is positioned at the same side of the base 120 as the position determining section 122. The side of the base 120 with the shaft section 123 is a side of the base 120 to which the cam pin 130 is attached.

In a state in which the head 110 is attached to the base 120, one or more (two in the present embodiment) temporary tacking members 140 and one or more (two in the present embodiment) restricting members 150 are attached to the base 120. The temporary tacking members 140 and the restricting members 150 are for example attached near to both ends of the head 110.

Each of the temporary tacking members 140 biases the head 110 in a specific direction and is, for example, a helical torsion spring. In the present embodiment, the temporary tacking members 140 apply a biasing force F to the head 110 in a direction toward the bottom-right of FIG. 16. The biasing force F is composed of a biasing force F1 in a longitudinal bias direction and a biasing force F2 in a lateral bias direction. The longitudinal bias direction is a direction from the first end to the second end of the head 110 in the longitudinal direction. The lateral bias direction is a direction from a side of the head 110 on which the protrusion 113*b* is provided toward a side of the head 110 on which the protrusion 113*b* is not provided in the lateral direction. Through the above, a force (biasing force F1) for longitudinal movement in the longitudinal bias direction is applied to the head 110 and a force (biasing force F2) for lateral movement in the lateral bias direction is applied to the head 110.

The restricting members 150 restrict shifting of the position of the head 110 when the head 110 is fixed to the base 120 by the head screws 115 after the position of the head 110 has been adjusted using the cam pin 130. The restricting members 150 each include, for example, a base plate 152 and two side plates 153 perpendicular to the base plate 152 as illustrated in FIG. 19. A through hole 151*d* is located in the center of the base plate 152. A restricting member screw 151 (refer to FIG. 16) passes through the through hole 151*d*. The two side plates 153 are connected symmetrically to the base plate 152 relative to the through hole 151*d* as a center. The side plates 153 each include a restricting tab 154. The restricting tabs 154 engage with the restricting grooves 126 of the base 120.

As illustrated in FIG. 17, at the second end of the head 110, the L-shaped notch 113*a* of the nozzle plate 113 is hooked against the position determining section 122 of the base 120. In other words, in a state in which the side surfaces Sa1 and Sa2 of the L-shaped notch 113*a* abut against the position determining section 122, the nozzle plate 113 is pressed against the position determining section 122 by the biasing force F. Through the above, movement of the head 110 according to the biasing force F is restricted by the position determining section 122, thereby determining a position (temporary position prior to adjustment) of the second end of the head 110. The nozzle plate 113 (head 110) is rotatable about the position determining section 122 as a rotational axis. The nozzle plate 113 (head 110) is moveable longitudinally in an opposite direction to the longitudinal bias direction (direction of the biasing force F1) and is moveable laterally in an opposite direction to the lateral bias direction (direction of the biasing force F2) by receiving an opposing force to the biasing force F.

As illustrated in FIG. 18, at the first end of the head 110, the supported surface Sb1 of the nozzle plate 113 is supported by the outer circumferential surface P2 of the cam pin 130. In other words, in a state in which the supported surface Sb1 of the nozzle plate 113 abuts against the outer circumferential surface P2 of the cam pin 130, the nozzle plate 113 is pressed against the outer circumferential surface P2 of the cam pin 130 by the biasing force F—particularly by the biasing force F2 in the lateral bias direction. Through the above, movement of the first end of the head 110 according to the biasing force F—particularly movement in the lateral bias direction—is restricted by the cam pin 130, thereby determining a position (temporary position prior to adjustment) of the first end of the head 110.

Once the position of the head 110 has been adjusted, a fastening operation of fixing the head 110 to the base 120 using the head screws 115 (fastening members) is performed, during which, a load (referred to below as a "fastening load") is applied to the head 110 in a direction in which the head screws 115 rotate. The fastening load may cause displacement of the position of the head 110 after adjustment against the biasing force F of the temporary tacking members 140. The restricting members 150 are provided in order to prevent shifting of the position of the head 110 after adjustment such as described above. In other words, the restricting members 150 hold the head 110 while the restricting tabs 154 of the restricting members 150 engage with the restricting grooves 126 of the base 120 such that the fastening load is received by the base 120. Through the above, the fastening load is prevented from causing shifting of the position of the head 110 after adjustment.

Figure 20:
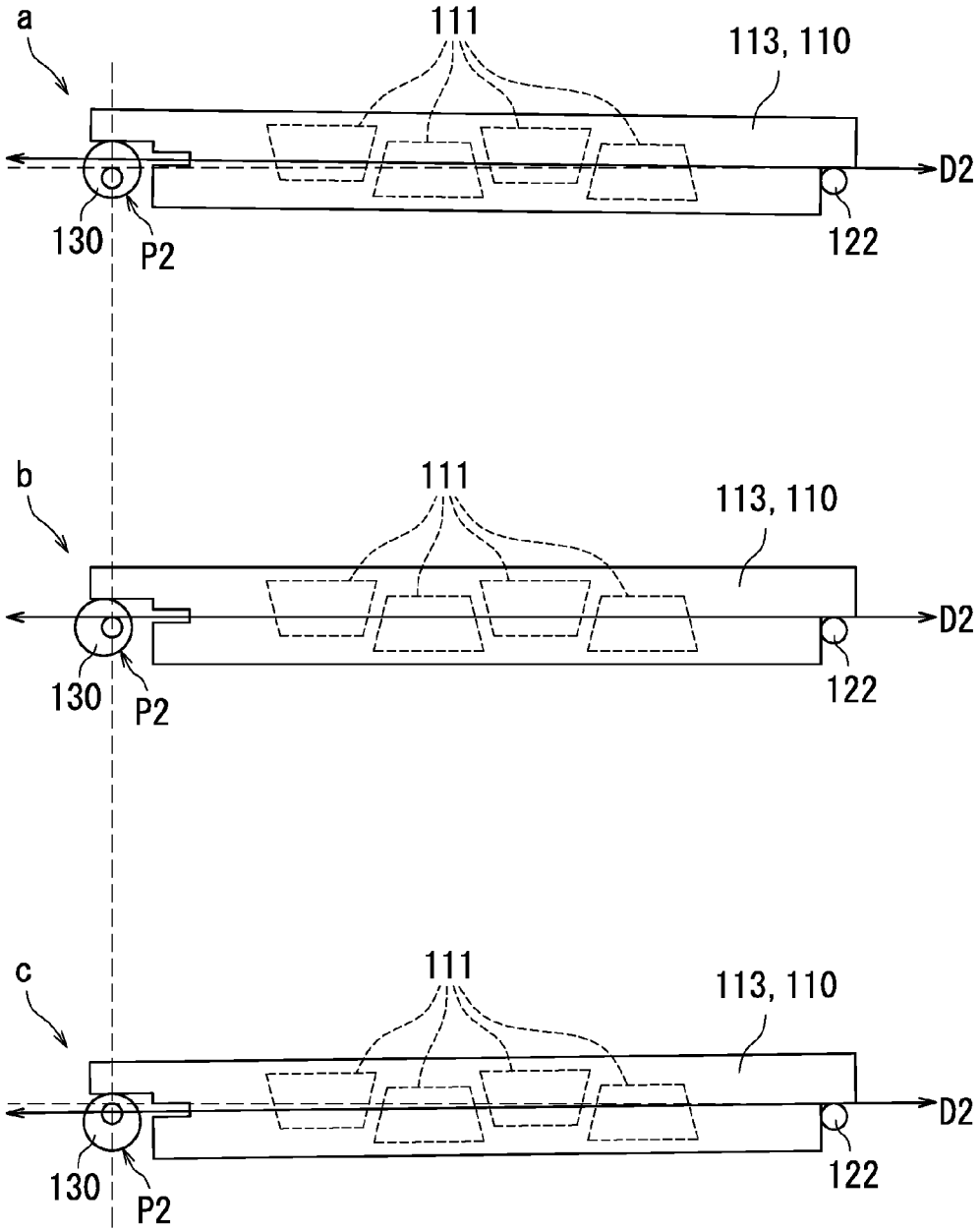
FIG. 20 illustrates change in position of the recording head resulting from rotation of the cam pin.

FIG. 20 illustrates change in the position of the recording head 110 resulting from rotation of the cam pin 130.

In the following explanation of FIG. 20, upward, downward, rightward, and leftward in FIG. 20 are referred to simply as "upward", "downward", "rightward", and "leftward." Furthermore, clockwise and counterclockwise directions in FIG. 20 are referred to simply as a "clockwise direction" and a "counterclockwise direction." Note that a left-right direction in FIG. 20 corresponds to the longitudinal direction of the base 120. Parts of the head 110 other than the nozzle plate 113 are omitted in FIG. 20.

State b in FIG. 20 illustrates the position of the head 110 and the orientation D2 of the nozzle rows 111*b* when the second eccentric cam member 132*b* of the cam pin 130 is in the second state. In the present embodiment, the orientation D2 of the nozzle rows 111*b* matches the longitudinal direction of the base 120 when the second eccentric cam member 132*b* is in the second state. In explanation of FIG. 20, it is assumed that the first eccentric cam member 131*b* is maintained in a constant state (for example, the fifth state).

State a in FIG. 20 illustrates the position of the head 110 and the orientation D2 of the nozzle rows 111*b* when the second eccentric cam member 132*b* of the cam pin 130 is in the third state. The third state is a state reached after the second eccentric cam member 132*b* rotates 90° in the clockwise direction from the second state.

The second-cam uppermost position (furthest upward position on the outer circumferential surface P2 of the cam pin 130) is further upward in the third state than in the second state. Consequently, rotation of the second eccentric cam member 132*b* from the second state to the third state causes the first end of the head 110 to be lifted upward by the cam pin 130.

Herein, the position of the second end of the head 110 is determined by the position determining section 122 and the biasing force F from the temporary tacking members 140. On the other hand, the head 110 is rotatable about the position determining section 122 as a rotational axis. Consequently, the first end of the head 110 is lifted upward such that the head 110 is slanted upward to the left and, in accordance therewith, the orientation D2 of the nozzle rows 111*b* becomes slanted upward to the left.

State c in FIG. 20 illustrates the position of the head 110 and the orientation D2 of the nozzle rows 111*b* when the second eccentric cam member 132*b* of the cam pin 130 is in the first state. The first state is a state reached after the second eccentric cam member 132*b* rotates 90° in the counterclockwise direction from the second state.

The second-cam uppermost position is further downward in the first state than in the second state. Herein, the first end of the head 110 is biased toward the cam pin 130 by the biasing force F from the temporary tacking members 140. Consequently, rotation of the second eccentric cam member 132*b* from the second state to the first state causes the first end of the head 110 to be pushed downward by the biasing force F. Consequently, the first end of the head 110 is pushed downward such that the head 110 is slanted downward to the left and, in accordance therewith, the orientation D2 of the nozzle rows 111*b* becomes slanted downward to the left.

As described above, the outer circumferential surface P2 of the cam pin 130 is displaced through rotation of the second eccentric cam member 132*b* such that the first end of the head 110 is lifted upward or pushed downward. As a result, the head 110 and the orientation D2 of the nozzle rows 111*b* become slanted. Therefore, the adjustor can displace the head 110 and change the orientation D2 of the nozzle rows 111*b* by rotating the second eccentric cam member 132*b* and can adjust the position of the head 110 so that the orientation D2 of the nozzle rows 111*b* is perpendicular to the sheet conveyance direction D1.

Although FIG. 20 is explained for an example in which the second eccentric cam member 132*b* rotates, the position of the head 110 changes in substantially the same way when the first eccentric cam member 131*b* rotates as when the second eccentric cam member 132*b* rotates, due to the rotation of the first eccentric cam member 131*b*. In other words, the outer circumferential surface P2 of the cam pin 130 is displaced through rotation of the first eccentric cam member 131*b* such that the first end of the head 110 is lifted upward or pushed downward. As a result, the head 110 and the orientation D2 of the nozzle rows 111*b* become slanted.

As explained above, the amount of displacement of the outer circumferential surface P2 of the second eccentric cam member 132*b* resulting from rotation of the first eccentric cam member 131*b* is smaller than the amount of displacement of the outer circumferential surface P2 of the second eccentric cam member 132*b* resulting from rotation of the second eccentric cam member 132*b*. Consequently, the degree of slanting of the orientation D2 of the nozzle rows 111*b* resulting from rotation of the first eccentric cam member 131*b* is smaller than the degree of slanting of the orientation D2 of the nozzle rows 111*b* resulting from rotation of the second eccentric cam member 132*b*. Therefore, the adjustor can adjust the orientation D2 of the nozzle rows 111*b* more precisely by rotating the first eccentric cam member 131*b* than by rotating the second eccentric cam member 132*b*. Thus, the adjustor can make adjustments involving relatively large changes (rough adjustments) to the orientation D2 of the nozzle rows 111*b* by rotating the second eccentric cam member 132*b* and can perform adjustments involving relatively small changes (fine adjustments) to the orientation D2 of the nozzle rows 111*b* by rotating the first eccentric cam member 131*b*. Through the above, the adjustor can precisely adjust the position of the recording head to an optimal position, which is a position at which the orientation D2 of the nozzle rows 111*b* is perpendicular to the sheet conveyance direction D1.

The position of the head 110 attached to the base 120 is for example adjusted using the cam pin 130 as described below. Specifically, rough adjustment of the position of the head 110 relative to the base 120 is performed first by rotating the outer cam 132. Next, fine adjustment of the position of the head 110 relative to the base 120 is performed by rotating the inner cam 131. After the position of the head 110 is adjusted through the rough adjustment and the fine adjustment, the head 110 is fixed to the base 120 using the head screws 115. It should be noted that the position of the head 110 may be adjusted by either or both of the rough adjustment and the fine adjustment. In other words, the head 110 may be fixed to the base 120 using the head screws 115 once the position of the head 110 has been adjusted by either or both of the rough adjustment and the fine adjustment.

Through the above, one embodiment of the present invention has been described. However, the present invention is not limited to the above embodiment and various alterations are possible without deviating from the essence of the present invention. The drawings schematically illustrate elements of configuration in order to facilitate understanding. Properties of the elements of configuration illustrated in the drawings, such as thickness, length, and quantity, may differ from reality in order to facilitate preparation of the drawings. Furthermore, properties of the elements of configuration indicated in the embodiment, such as materials, shapes, and dimensions, are merely examples and are not intended to be limitations.

For example, the positioning and number of the bases 120, the heads 110, and the nozzle units 111 illustrated in FIGS. 3 and 4 are merely examples, and the positioning and number of the bases 120, the heads 110, and the nozzle units 111 may differ from those illustrated in FIGS. 3 and 4. Furthermore, the positioning and number of the nozzle orifices 111*a* and the nozzle rows 111*b* illustrated in FIG. 8 are merely examples, and the positioning and number of the nozzle orifices 111*a* and the nozzle rows 111*b* may differ from those illustrated in FIG. 8.

Although, for example, the first eccentric cam member 131*b* has a circular plate shape in the present embodiment, the first eccentric cam member 131*b* is not limited to having a circular plate shape and may have another shape about which the second eccentric cam member 132*b* can rotate as a rotational axis, such as a prism shape.

Although, for example, the outer cam 132 is an eccentric cam in the present embodiment, the outer cam 132 is not limited to being an eccentric cam and may be another type of cam having a non-uniform distance between an axial center O1 of a rotational axis thereof and an outer circumferential surface P2 thereof.

Furthermore, although the present embodiment is explained for an example in which the target object attached to the attachment base is a recording head, the target object is not limited to being a recording head and may be another object for which positioning adjustment is required.

The invention claimed is:

1. An adjustment mechanism for adjusting a position of a recording head attached to an attachment base, comprising:

a first cam configured to be fittable in a shaft section protruding from the attachment base; and a second cam supported by the first cam in a rotatable manner and configured to come in contact at an outer circumferential surface thereof with the recording head, wherein the second cam internally houses the first cam, the second cam has an inner circumferential surface in contact with an outer circumferential surface of the first cam in a slidable manner, the first cam displaces an outer circumferential surface of the second cam by rotating about the shaft section as a rotational axis, the second cam displaces the outer circumferential surface of the second cam by rotating about the first cam as a rotational axis, when the outer circumferential surface of the second cam is displace, the recording head displaces, and an amount of displacement of the recording head resulting from rotation of the first cam differs from an amount of displacement of the recording head resulting from rotation of the second cam.

2. The adjustment mechanism according to claim 1, wherein the amount of displacement of the recording head resulting from rotation of the first cam is smaller than the amount of displacement of the recording head resulting from rotation of the second cam.

3. The adjustment mechanism according to claim 1, wherein the first cam includes:

a first eccentric cam member having a central axis that is offset from an axial center of the rotational axis of the first cam by a specific first distance, the first eccentric cam member being a cylindrical member having a first fitting hole that fits slidably with the shaft section; and a first operation section that receives a first operation that rotates the first eccentric cam member, the second cam includes:

a second eccentric cam member having a central axis that is offset from an axial center of the rotational axis of the second cam by a specific second distance that differs from the specific first distance, the second eccentric cam member being a cylindrical member having a second fitting hole that fits slidably with an outer circumferential surface of the first eccentric cam member; and a second operation section that receives a second operation that rotates the second eccentric cam member, the outer circumferential surface of the first eccentric cam member displaces the second cam and the recording head as a result of the first eccentric cam member rotating based on the first operation, and an outer circumferential surface of the second eccentric cam member displaces the recording head as a result of the second eccentric cam member rotating based on the second operation.

4. The adjustment mechanism according to claim 3, further comprising a biasing member configured to bias a first bottom surface on a side of the first eccentric cam member facing the attachment base toward the attachment base and to bias a second bottom surface on a side of the second eccentric cam member not facing the attachment base toward a covering section of the recording head that covers the second bottom surface, wherein the attachment base includes a plurality of first grooves arranged radially around the shaft section, the covering section includes a plurality of second grooves arranged radially on a surface of the covering section that faces the second bottom surface, the first bottom surface has a first protrusion thereon that moves into the plurality of first grooves in order as the first eccentric cam member rotates, and the second bottom surface has a second protrusion thereon that moves into the plurality of second grooves in order as the second eccentric cam member rotates.

5. The adjustment mechanism according to claim 4, wherein during rotation of the first eccentric cam member, the second protrusion remains in one second groove among the plurality of second grooves as a result of the biasing member biasing the second bottom surface toward the covering section, and during rotation of the second eccentric cam member, the first protrusion remains in one first groove among the plurality of first grooves as a result of the biasing member biasing the first bottom surface toward the attachment base.

6. The adjustment mechanism according to claim 4, wherein two adjacent first grooves among the plurality of first grooves are separated by an interval such that an amount of displacement of the recording head when the first protrusion moves between the two adjacent first grooves is a specific first value, and two adjacent second grooves among the plurality of second grooves are separated by an interval such that an amount of displacement of the recording head when the second protrusion moves between the two adjacent second grooves is a specific second value.

7. The adjustment mechanism according to claim 4, wherein the first cam, the second cam, and the biasing member have an integrated structure, and the first cam, the second cam, and the biasing member are integrally attached to the attachment base through attachment of the first cam to the shaft section.

8. The adjustment mechanism according to claim 3, wherein in a situation in which:

a position on the outer circumferential surface of the second eccentric cam member that is closest to the axial center of the rotational axis of the second eccentric cam member is defined as a second-cam innermost position;

a position on the outer circumferential surface of the second eccentric cam member that is furthest upward is defined as a second-cam uppermost position;

a state in which the second-cam innermost position is located at the second-cam uppermost position is defined as a first state; and a state after the second eccentric cam member has rotated 90° in a clockwise direction from the first state is defined as a second state, when the second eccentric cam member rotates 90° in the clockwise direction from the first state, the second-cam innermost position moves from the second-cam uppermost position to a furthest rightward position on the outer circumferential surface of the second eccentric member, and the second-cam uppermost position becomes located further upward in the second state than in the first state.

9. The adjustment mechanism according to claim 8, wherein in a situation in which:

a position on the outer circumferential surface of the second eccentric cam member that is furthest from the axial center of the rotational axis of the second eccentric cam member is defined as a second-cam outermost position; and a state after the second eccentric cam member has rotated 90° in the clockwise direction from the second state is defined as a third state, when the second eccentric cam member rotates 90° in the clockwise direction from the second state, the second-cam innermost position moves from the furthest rightward position to a furthest downward position on the outer circumferential surface of the second eccentric member, the second-cam outermost position becomes located at the second-cam uppermost position, and the second-cam uppermost position becomes located further upward in the third state than in the second state.

10. The adjustment mechanism according to claim 3, wherein in a situation in which:

a position on the outer circumferential surface of the first eccentric cam member that is closest to the axial center of the rotational axis of the first eccentric cam member is defined as a first-cam innermost position;

a position on the outer circumferential surface of the first eccentric cam member that is furthest upward is defined as a first-cam uppermost position;

a position on the outer circumferential surface of the second eccentric cam member that is closest to the axial center of the rotational axis of the second eccentric cam member is defined as a second-cam innermost position;

a position on the outer circumferential surface of the second eccentric cam member that is furthest upward is defined as a second-cam uppermost position;

a state in which the second-cam innermost position is located at the second-cam uppermost position is defined as a first state;

a state in which the first-cam innermost position is located at the first-cam uppermost position is defined as a fourth state; and a state after the first eccentric cam member has rotated 90° in a clockwise direction from the fourth state is defined as a fifth state, when the first eccentric cam member rotates 90° in the clockwise direction from the fourth state, the first-cam innermost position moves from the first-cam uppermost position to a furthest rightward position on the outer circumferential surface of the first eccentric cam member, the first eccentric cam member slides against a circumferential surface of the second fitting hole, the second eccentric cam member remains in the first state or a similar state to the first state, and the second-cam uppermost position becomes located further upward in the fifth state than in the fourth state.

11. The adjustment mechanism according to claim 10, wherein in a situation in which:

a position on the outer circumferential surface of the first eccentric cam member that is furthest from the axial center of the rotational axis of the first eccentric cam member is defined as a first-cam outermost position, and a state after the first eccentric cam member has rotated 90° in the clockwise direction from the fifth state is defined as a sixth state, when the first eccentric cam member rotates 90° in the clockwise direction from the fifth state, the first-cam innermost position moves from the furthest rightward position to a furthest downward position on the outer circumferential surface of the first eccentric cam member, the first-cam outermost position becomes located at the first-cam uppermost position, the first eccentric cam member slides against the circumferential surface of the second fitting hole, the second eccentric cam member remains in the first state or a similar state to the first state, and the second-cam uppermost position becomes located further upward in the sixth state than in the fifth state.

12. The adjustment mechanism according to claim 1, wherein the attachment base includes a restricting member that, after the position of the recording head has been adjusted by the adjustment mechanism, restricts shifting of the position of the recording head due to fastening load during fixing of the recording head to the attachment base using a fastening member.

13. The adjustment mechanism according to claim 12, wherein the attachment base includes a restricting groove, and the restricting member includes a restricting tab that engages with the restricting groove.

14. An image forming apparatus for forming an image on a recording medium, comprising:

the adjustment mechanism according to claim 1;

the attachment base; and the recording head.

15. An adjustment method using the adjustment mechanism according to claim 1 to adjust the position of the recording head attached to the attachment base, wherein the amount of displacement of the target object resulting from rotation of the first cam is smaller than the amount of displacement of the recording head resulting from rotation of the second cam, the adjustment method comprising:

roughly adjusting the position of the recording head relative to the attachment base by rotating the second cam;

finely adjusting the position of the recording head relative to the attachment base by rotating the first cam; and fixing the recording head to the attachment base using a fastening member after the position of the recording head has been adjusted through either or both of the roughly adjusting and the finely adjusting.

16. An adjustment mechanism for adjusting a position of a recording head attached to an attachment base, comprising:

a first cam configured to be attachable to a shaft section provided on the attachment base; and a second cam configured to internally house the first cam and support the recording head, wherein the first cam displaces the recording head via the second cam by rotating about the shaft section as a rotational axis, the second cam displaces the recording head by rotating about the first cam as a rotational axis, an amount of displacement of the recording head resulting from rotation of the first cam differs from an amount of displacement of the recording head resulting from rotation of the second cam, the first cam includes:

a first eccentric cam member having a central axis that is offset from an axial center of the rotational axis of the first cam by a specific first distance, the first eccentric cam member being a cylindrical member having a first fitting hole that fits slidably with the shaft section; and a first operation section that receives a first operation that rotates the first eccentric cam member, the second cam includes:

a second eccentric cam member having a central axis that is offset from an axial center of the rotational axis of the second cam by a specific second distance that differs from the specific first distance, the second eccentric cam member being a cylindrical member having a second fitting hole that fits slidably with an outer circumferential surface of the first eccentric cam member; and a second operation section that receives a second operation that rotates the second eccentric cam member, the outer circumferential surface of the first eccentric cam member displaces the second cam and the recording head as a result of the first eccentric cam member rotating based on the first operation, and an outer circumferential surface of the second eccentric cam member displaces the recording head as a result of the second eccentric cam member rotating based on the second operation.

17. An adjustment mechanism for adjusting a position of a recording head attached to an attachment base, comprising:

a first cam configured to be attachable to a shaft section provided on the attachment base;

a second cam configured to internally house the first cam and support the recording head; and a restricting member attached to the attachment base, wherein the first cam displaces the recording head via the second cam by rotating about the shaft section as a rotational axis, the second cam displaces the recording head by rotating about the first cam as a rotational axis, an amount of displacement of the recording head resulting from rotation of the first cam differs from an amount of displacement of the recording head resulting from rotation of the second cam, the restricting member, after the position of the recording head has been adjusted by at least one of the first and second cams, restricts shifting of the position of the recording head due to fastening load during fixing of the recording head to the attachment base using a fastening member, the restricting member includes:

a base plate located opposite to the attachment base; and two side plates each standing from the base plate perpendicularly to the base plate, the base plate has a through hole through which a restricting member screw passes to be fastened to the attachment base, the two side plates are located opposite to each other with the through hole therebetween, the attachment base has a plurality of restricting grooves, and the two side plates are fitted in respective two of the restricting grooves.

* * * * *